US010449500B2

(12) United States Patent
Jin et al.

(10) Patent No.: US 10,449,500 B2
(45) Date of Patent: Oct. 22, 2019

(54) WINE DECANTER AND WINE DECANTING DEVICE

(71) Applicants: Tao Jin, Guangdong (CN); Jian Wu, Guangdong (CN)

(72) Inventors: Tao Jin, Guangdong (CN); Jian Wu, Guangdong (CN)

( * ) Notice: Subject to any disclaimer, the term of this patent is extended or adjusted under 35 U.S.C. 154(b) by 0 days.

(21) Appl. No.: 16/021,078

(22) Filed: Jun. 28, 2018

(65) Prior Publication Data

US 2019/0151811 A1 May 23, 2019

Related U.S. Application Data

(63) Continuation-in-part of application No. PCT/CN2018/073023, filed on Jan. 17, 2018.

(30) Foreign Application Priority Data

Nov. 20, 2017 (CN) ..... 2017 2 1555695 U

(51) Int. Cl.

| | |
|---|---|
| ***B01F 13/00*** | (2006.01) |
| ***B01F 13/08*** | (2006.01) |
| ***B01F 3/04*** | (2006.01) |
| ***B01F 11/00*** | (2006.01) |
| ***B01F 15/00*** | (2006.01) |

(52) U.S. Cl.

CPC ..... *B01F 13/0818* (2013.01); *B01F 3/04531* (2013.01); *B01F 3/04794* (2013.01); *B01F 11/0082* (2013.01); *B01F 13/0827* (2013.01); *B01F 13/0863* (2013.01);

(Continued)

(58) Field of Classification Search

CPC ..... B01F 13/0818; B01F 3/04531; B01F 3/04794; B01F 11/0082; B01F 13/0827; B01F 13/0863; B01F 15/00883; B01F 2003/04865; B01F 2215/0072

See application file for complete search history.

(56) References Cited

U.S. PATENT DOCUMENTS 4,494,452 A 1/1985 Barzso
6,332,706 B1 * 12/2001 Hall ..... B01F 3/04794 261/83

(Continued)

FOREIGN PATENT DOCUMENTS

CN 104968423 A 10/2015
CN 104970714 A 10/2015

*Primary Examiner* — Anshu Bhatia

(57) ABSTRACT

A wine decanter includes a housing and a variation magnetic field generator, where the variation magnetic field generator is configured to generate a variation magnetic field, and the variation magnetic field generator generates the variation magnetic field, so that a movement component that can sense a magnetic field moves in wine to make the wine move, thereby increasing contact between the wine and air. The decanting device includes a wine container, a movement component, and the decanter according to any one of the foregoing, where the movement component is placed inside the wine container, the decanter is connected to the movement component by using a magnetic field, and the decanter generates a variation magnetic field to drive the movement component to perform decanting. The structure of the decanter is simplified, thereby facilitating miniaturization, and making it convenient to carry the decanter, and also reducing noises.

18 Claims, 24 Drawing Sheets

(52) U.S. Cl.
CPC ..... *B01F 15/00883* (2013.01); *B01F 2003/04865* (2013.01); *B01F 2215/0072* (2013.01)

(56) References Cited

U.S. PATENT DOCUMENTS

| | | | | |
|---|---|---|---|---|
| 2013/0334246 | A1 | 12/2013 | Houck et al. | |
| 2015/0314253 | A1 | 11/2015 | Cysewski et al. | |
| 2015/0329809 | A1 | 11/2015 | Cifaldi | |
| 2017/0312713 | A1* | 11/2017 | Schob | B01F 13/0836 |

* cited by examiner

WINE DECANTER AND WINE DECANTING DEVICE

CROSS REFERENCE TO RELATED APPLICATIONS

This application is a continuation-in-part application of PCT/CN2018/073023, filed on Jan. 17, 2018, which claims the priority of China patent application No. 201721555695.5 filed on Nov. 20, 2017. The contents of the above-mentioned applications are all hereby incorporated by reference.

BACKGROUND

Field of the Invention

The present invention relates to the field of wine processing technologies, and in particular, to a wine decanter and a wine decanting device including the decanter.

Related Arts

With the improvement of life standards, an increasing number of people start to drink grape wine. However, decanting needs to be performed before the grape wine is drunk, and the decanting process takes a relatively long time. To accelerate the decanting process, people complete decanting by using a decanting tool. One decanting tool is a rotatable decanting device, and this device includes a wine container, a driven rotor, and a base. The base is provided with a driving component. The driven rotor is placed in the wine container. When working, the driving component drives the driven rotor to rotate, so that grape wine in the wine container rotates, thereby implementing quick decanting. However, the driven rotor can be driven only when the driving component rotates by itself, and usually, the driving component is connected to an output shaft of a motor. In this way, many mechanical transmission mechanisms need to be used. Consequently, the structure of the decanting device is complex, leading to inconvenient carriage.

SUMMARY

The present invention is directed to resolve the problem of inconvenient carriage in the prior art, and provides a wine decanter and a wine decanting device.

To resolve the foregoing technical problem, the present invention uses the following technical solutions:

A wine decanter, including a housing and a variation magnetic field generator, where the variation magnetic field generator is configured to generate a variation magnetic field, and the variation magnetic field generator generates the variation magnetic field, so that a movement component that can sense a magnetic field moves in wine to make the wine move, thereby increasing contact between the wine and air.

In some preferred implementations, the magnetic field generated by the variation magnetic field generator drives the movement component to move in the wine, so that a gas channel for gas inlet is formed in the wine, and the movement component beats air entering the gas channel into the wine.

In some preferred implementations, the magnetic field generated by the variation magnetic field generator drives the movement component to rotate in the wine, so that a gas channel for gas inlet is formed in the wine, and the movement component beats air entering the gas channel into the wine.

In some preferred implementations, a magnetic field adjustment unit is further included, where the magnetic field adjustment unit is connected to the housing or disposed in the variation magnetic field generator, and is configured to adjust distribution of magnetic fields generated by the variation magnetic field generator; and by means of adjustment of the distribution of magnetic fields, the movement component that can sense a magnetic field moves to different locations in the wine for movement, to enhance a decanting effect.

In further preferred implementations, types of the magnetic field adjustment unit include a magnetic field space distribution adjustment unit and a magnetic field strength distribution adjustment unit, the magnetic field space distribution adjustment unit is connected to the housing, the magnetic field strength distribution adjustment unit is disposed in the variation magnetic field generator, the magnetic field space distribution adjustment unit is configured to change a spatial location of a magnetic field, and the magnetic field strength distribution adjustment unit is configured to adjust strength distribution of magnetic fields.

In some preferred implementations, the variation magnetic field generator includes a coil winding and a power supply circuit, and the coil winding is connected to the power supply circuit.

In further preferred implementations, the magnetic field strength distribution adjustment unit includes a control unit, a power supply circuit, and an adjustment coil winding, the control unit is configured to send a control signal to the power supply circuit, the adjustment coil winding is connected to the power supply circuit, and the control signal of the control unit can control strength of a magnetic field generated by the adjustment coil winding.

In further preferred implementations, the magnetic field space distribution adjustment unit includes a translation mechanism and a supporting structure, the translation mechanism is configured to move the housing, and the supporting structure is configured to support a wine container, so that the housing can move relative to the wine container.

In some preferred implementations, the variation magnetic field generator is a stator.

In further preferred implementations, shapes of the decanter include a disk shape, an annular shape, and a flat shape.

In some preferred implementations, a variation of the magnetic field generated by the variation magnetic field generator includes a magnetic field direction variation, a magnetic field strength variation, a magnetic field distribution variation, or a magnetic field direction and distribution variation.

In further preferred implementations, there is one, two, three, four, or more coil windings.

In some preferred implementations, a control unit is further included, where the control unit is connected to the power supply circuit, and the control unit is configured to change an output signal of the power supply circuit.

In some preferred implementations, types of movement of the movement component in the wine include rotation, vibration, and translation.

The present invention further provides a wine decanting device, including a wine container, a movement component, and the decanter according to any one of the foregoing, where the movement component is placed inside the wine container, the decanter is connected to the movement component by using a magnetic field, and the decanter generates a variation magnetic field to drive the movement component to perform decanting.

In some preferred implementations, the decanter and the movement component are disposed in a separate manner.

In some preferred implementations, the movement component is partially a magnetic material or is entirely a magnetic material.

In further preferred implementations, the movement component is partially a magnetic material, and the magnetic material is disposed on two ends of the movement component or is disposed in the middle of the movement component.

In some preferred implementations, a rotation space is disposed inside the wine container, a top cover is disposed on top of the rotation space, a picking and placing port is disposed on the top over, and the rotation space is used for accommodating a decanting rotor; and the decanting device further includes a picking and placing component, one end of the picking and placing component is provided with an attraction component, and the attraction component is connected to the picking and placing port of the wine container in a matching manner for cooperative use, and the attraction component is a magnetic field sensing component.

Compared with the prior art, the present invention has the following beneficial effects:

The decanter generates the variation magnetic field by using the variation magnetic field generator, to drive the movement component used as the magnetic field sensing component, and only one generator that can generate a variation magnetic field needs to be designed. In this way, a complex mechanical transmission structure is avoided, so as to simplify the structure of the decanter, thereby facilitating miniaturization, and making it convenient to carry the decanter.

In a preferred implementation, the present invention further has the following beneficial effects:

Further, the magnetic field generated by the variation magnetic field generator drives the movement component to move in the wine, so that the gas channel for gas inlet is formed in the wine. In this way, the moving movement component beats the air entering the gas channel into the wine, so that the air is quickly dispersed in the wine and comes into contact with wine at various locations, thereby accelerating the decanting speed and enhancing the decanting effect.

Further, by adjusting the distribution of magnetic fields by the magnetic field adjustment unit, the movement component moves to different locations in the wine for rotation, so that the gas channel is formed at different locations in the wine, and the air entering the gas channel is beat, at these locations, into the wine, to sufficiently implement decanting, thereby enhancing the decanting effect and accelerating the decanting speed.

Further, the coil winding is used as a main component of the variation magnetic field generator. Because the coil winding can be designed to be thin, and can also be conveniently processed into various shapes, the decanter can be made into any shape, facilitating reduction of the volume, and facilitating use, carriage, movement, or transportation.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The present invention is described in further detail below with reference to embodiments and the accompanying drawings.

The implementations of the present invention are described in detail below. The decanting object herein is grape wine, but is not limited to the grape wine. The present invention is also applicable to other wine that needs to be decanted. The gas described in the present invention refers to a gas having a function of decanting, such as air and oxygen, but the present invention is not limited to these gases. It should be emphasized that the following description is merely exemplary, and is not intended to limit the scope and applications of the present invention.

Figure 1:
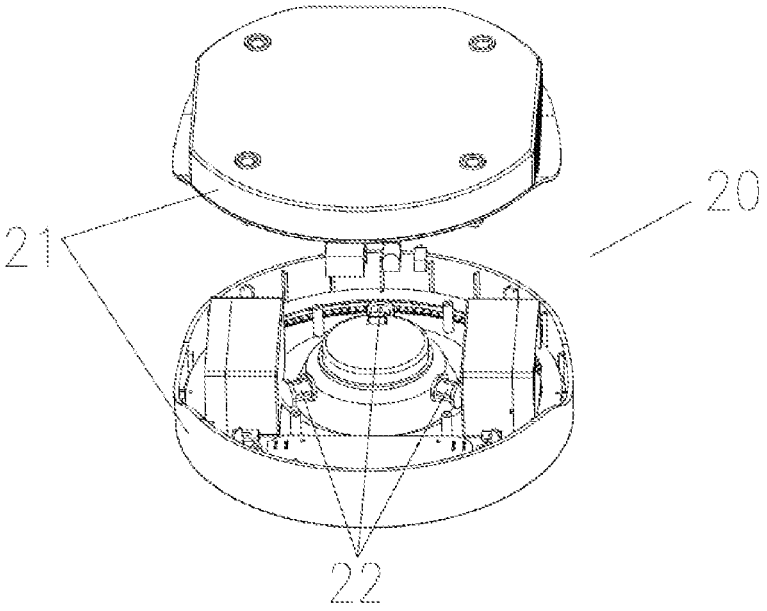
FIG. 1 is a schematic structural diagram of a decanter of the present invention.

Referring to FIG. 1, a wine decanter 20 of the present invention includes a housing 21 and a force field generator. The housing 21 is configured to accommodate the force field generator. The force field generator is disposed on the housing 21 or in the housing 21. The force field generator is configured to generate a force field during work to drive a force field sensing component. Specifically, the force field generator is a variation magnetic field generator 22. The variation magnetic field generator 22 is configured to generate a variation magnetic field. In the present invention, the variation magnetic field generator 22 generates the variation magnetic field, so that a movement component 13 that can sense a magnetic field moves in wine to make the wine move, thereby increasing contact between the wine and air. Specific forms of movement of the wine include fluctuation, shaking, and rotation of a liquid level of the wine. A magnetic field variation includes a magnetic field direction variation, a magnetic field strength variation, a magnetic field distribution variation, or a magnetic field direction and distribution variation. The present invention is not limited thereto, provided that the magnetic field variation is a magnetic field variation that can enable a component that can sense a magnetic field to move in the wine.

Figure 2:
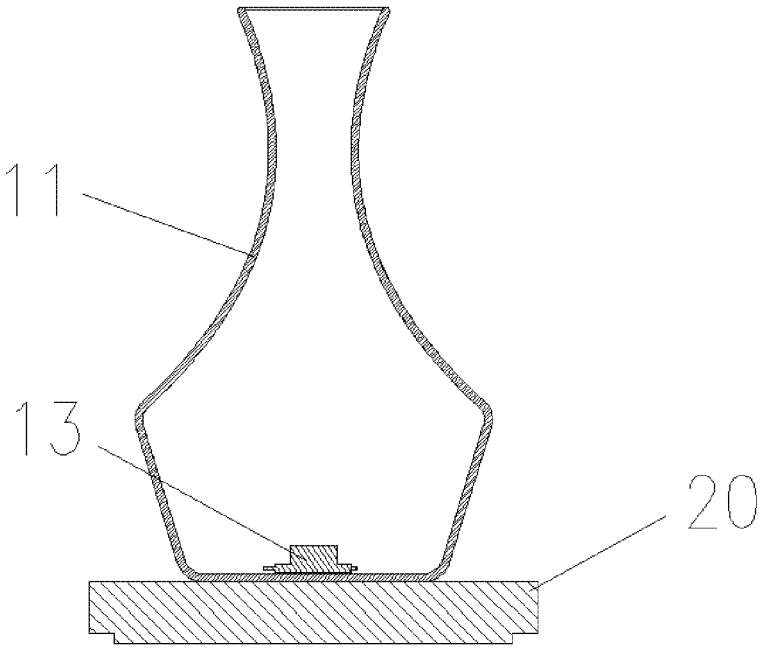
FIG. 2 is a schematic structural diagram of a decanting device of the present invention.

Referring to FIG. 1 and FIG. 2, a decanting device of the present invention includes a decanter 20, a wine container 11, and a movement component 13. The movement component 13 is placed inside the wine container 11, and is a magnetic field sensing component. The decanter 20 is connected to the movement component 13 by using a magnetic field. The decanter 20 generates a variation magnetic field, to drive the movement component 13 to perform decanting.

Specifically, the decanter 20 and the movement component 13 are disposed in a separate manner. The decanter 20 may be disposed inside or outside the wine container 11. The movement component 13 is accommodated in the wine container 11. The variation magnetic field generator 22 of the decanter 20 generates a variation magnetic field, to drive the movement component 13 to perform decanting, avoiding mechanical cooperation between components. Both the operation and daily maintenance are easy, facilitating use, and in particular, facilitating daily maintenance of the movement component 13.

Referring to FIG. 1 and FIG. 2, the wine container 11 is placed on the decanter 20, grape wine is added to the wine container 11, and a power supply of the variation magnetic field generator 22 is connected. The variation magnetic field generator 22 generates a variation magnetic field. Under the effect of the variation magnetic field, the movement component 13 starts to move, to make the grape wine in the wine container 11 move, thereby increasing contact between the wine and air, and this is specifically reflected in that a liquid level of the grape wine moves, and this movement makes the grape wine come into contact with more air, or makes grape wine at different locations in the wine container 11 come into contact with air, thereby implementing decanting.

According to the foregoing description, it can be learned that when working, the variation magnetic field generator 22 generates the variation magnetic field, and the movement component 13 used as the magnetic field sensing component is driven by using the variation magnetic field, and only one generator that can generate a variation magnetic field needs to be designed. In this way, a complex mechanical transmission structure is avoided, so as to simplify the structure of the decanter 20, thereby facilitating miniaturization, and making it convenient to carry the decanter 20. In addition, an acting force between the decanter 20 and the movement component 13 is a magnetic field force, which is a non-contact force, to avoid mechanical transmission, thereby facilitating reduction of noises. The variation magnetic field generator 20 generates a magnetic field only when at work, to reduce magnetic field pollution.

Figure 5:
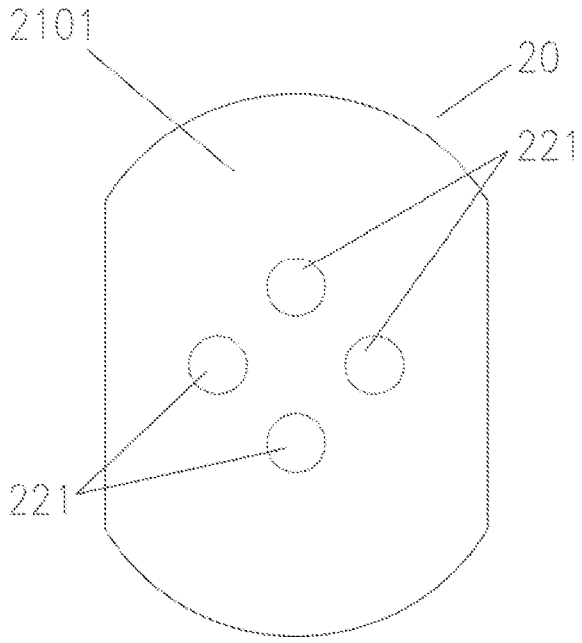
FIG. 5 is a schematic structural diagram of another variation manner of the decanter of FIG. 3.

In the present invention:

Referring to FIG. 5, the variation magnetic field generator 22 may generate a magnetic field by using a coil winding 221. The coil winding 221 can generate a magnetic field after being powered on. An iron core may further be embedded in the coil winding 221 to enhance the strength of the generated magnetic field. Types of the iron core include but are not limited to a silicon steel sheet, pure iron, and an iron-based nanocrystalline alloy, or a magnetic field can be generated by using both the coil winding 221 and a permanent magnet. The coil winding 221 is used as a main component of the variation magnetic field generator 22. The coil winding 221 can be designed to be thin, and can also be conveniently processed into various shapes, so that the decanter 20 can be made into any shape including a disk shape, an annular shape, and a flat shape, facilitating reduction of the volume, and facilitating use, carriage, movement, or transportation. For example, the annular decanter 20 may be sleeved outside the wine container 11, and the wine container 11 does not need to be moved; and the flat decanter has a small volume and is thin, and is convenient to carry.

Referring to FIG. 1, the variation magnetic field generator 22 is mounted in the housing 21, and the variation magnetic field generator 22 is a stator. To drive the movement component 13, the variation magnetic field generator 22 may also be set to be rotatable, provided that a rotation mechanism connected to the housing 21 is disposed.

Figure 41:
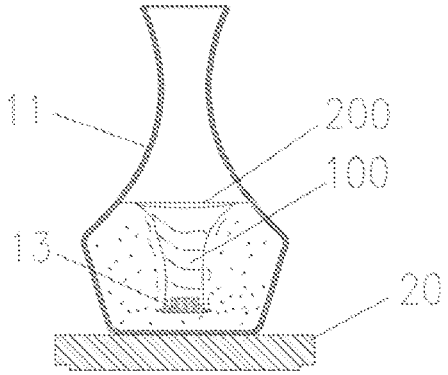
FIG. 41 is a diagram of a working state of a decanting device of the present invention.

In the present invention, the variation magnetic field generator 22 is set in the following manner:

Referring to FIG. 41, the magnetic field generated by the variation magnetic field generator 22 drives the movement component 13 to move in the grape wine, so that a gas channel 100 for gas inlet is formed in the grape wine, and external air enters the gas channel 100 to come into contact with the movement component 13. Referring to FIG. 41, the movement component 13 moves in the wine container 11, to beat air in the gas channel 100 into the grape wine. In this way, air can be quickly dispersed into the grape wine of the wine container 11, so that the grape wine constantly comes into contact with air, thereby accelerating the decanting speed and enhancing the decanting effect.

Figure 42:
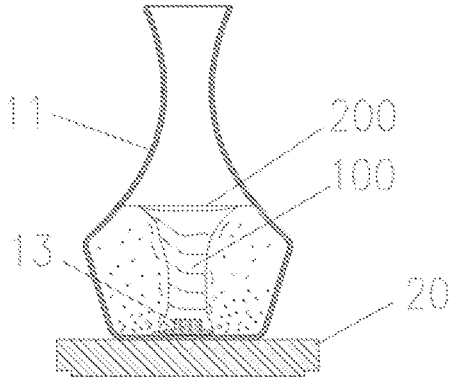
FIG. 42 is a diagram of another working state of a decanting device of the present invention.

Referring to FIG. 42, to make decanting more sufficient, the variation magnetic field generator 22 may also be set in the following manner: the movement component 13 is enabled to move at the bottom of the wine container 11, and the gas channel 100 for gas inlet is formed in the grape wine. That is, the gas channel 100 is formed between the bottom of the wine container 11 and a liquid level 200. Air can come into contact with the movement component 13 by using the gas channel 100, and the air is beat into the grape wine by the movement component 13. In this way, the air can come into contact with grape wine at various locations of the wine container 11 by using the gas channel 100, thereby further enhancing the decanting effect.

Figure 3:
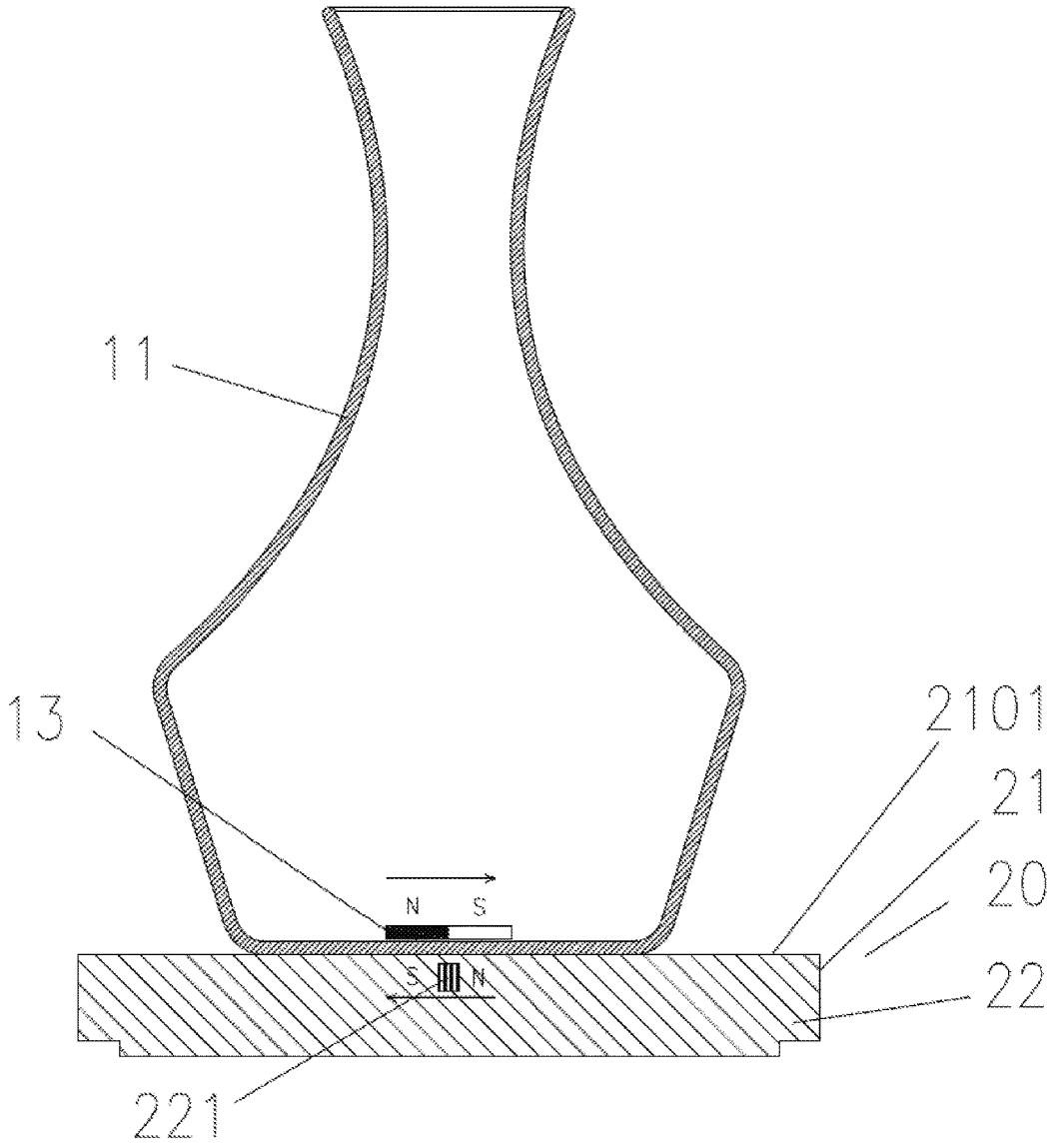
FIG. 3 is a schematic structural diagram of another structure of a decanter of the present invention.
Figure 43:
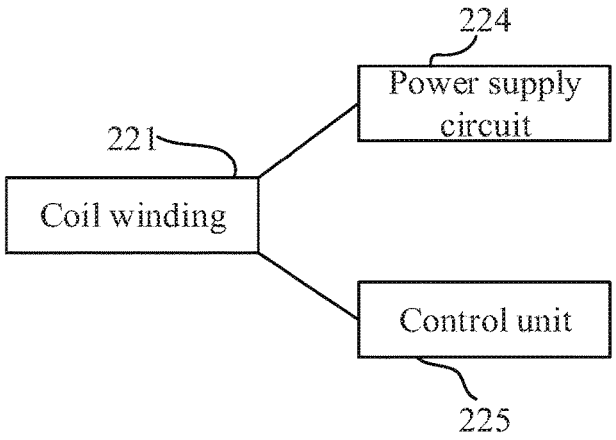
FIG. 43 is a schematic structural diagram of a circuit of a variation magnetic field generator of the present invention.

Referring to FIG. 3 and FIG. 43, in the present invention:

The variation magnetic field generator 22 generates a magnetic field with a varied magnetic field direction.

Referring to FIG. 43, the variation magnetic field generator 22 specifically includes the coil winding 221 and a power supply circuit 224. The coil winding 221 is connected to the power supply circuit 224. The power supply circuit 224 is configured to supply power to the coil winding 221, so that the coil winding 221 generates a variation magnetic field. By using the power supply circuit 224, the variation magnetic field generator 22 can generate various magnetic fields, such as the following magnetic field: the movement component 13 is driven to move in the grape wine, so that the gas channel 100 for gas inlet is formed in the grape wine. Specifically, an existing circuit structure may be specifically used in the power supply circuit 224. The power supply circuit 224 makes the movement component 13 move quickly enough, so that the gas channel 100 is formed in the grape wine.

Referring to FIG. 3, specifically, there is one coil winding 221, which is fixed in the housing 21. A coil stacking direction of the coil winding 221 is parallel or approximately parallel to an upper surface 2101 of the housing 21. That is, a direction of a magnetic field generated by the coil winding 221 when the coil winding 221 is powered on is also parallel or approximately parallel to the upper surface 2101 of the housing 21, or in other words, the direction of the magnetic field generated by the variation magnetic field generator 22 is radial. The power supply circuit 224 provides a pulse signal for the coil winding 221, so that the coil winding 221 generates a magnetic field with a varied direction. The power supply circuit 224 uses an existing pulse signal circuit, and main components include a clock chip and an MOS tube.

Specific forms of movement of the movement component 13 in the grape wine include rotation, vibration, and translation, and may be designed according to actual situations. The present invention is not limited thereto. The following further describes the present invention mainly by using rotation as an example.

Figure 6:
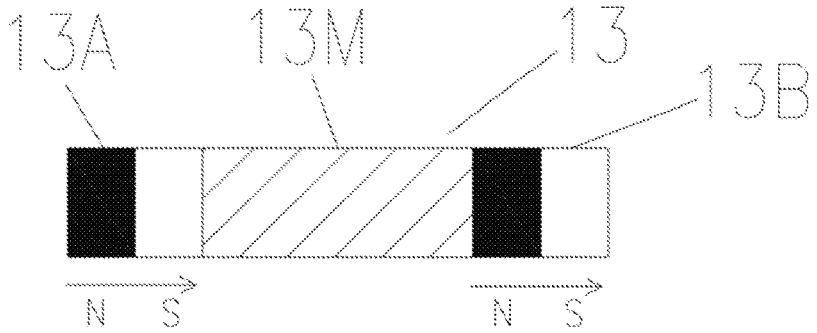
FIG. 6 is a schematic structural diagram of a variation manner of a movement component of the present invention.

The movement component 13 is a rotor. The movement component 13 is entirely a magnetic material, which is specifically a permanent magnet. Referring to FIG. 6, the movement component 13 is bar-shaped, and a magnetization direction thereof is along a length direction. That is, N and S poles are respectively on two ends of the movement component 13.

Referring to FIG. 3, at work, the wine container 11 is placed on the upper surface 2101 of the decanter 20, the movement component 13 is placed in the wine container 11, and the wine container 11 is a glass decanting container. After the power supply circuit 224 is started, the direction of the magnetic field generated by the coil winding 221 is parallel or approximately parallel to the movement component 13. The direction of the magnetic field generated by the coil winding 221 periodically changes. One of the N and S poles of the movement component 13 is repelled, and the other one is attracted, so that the movement component 13 rotates.

Figure 4:
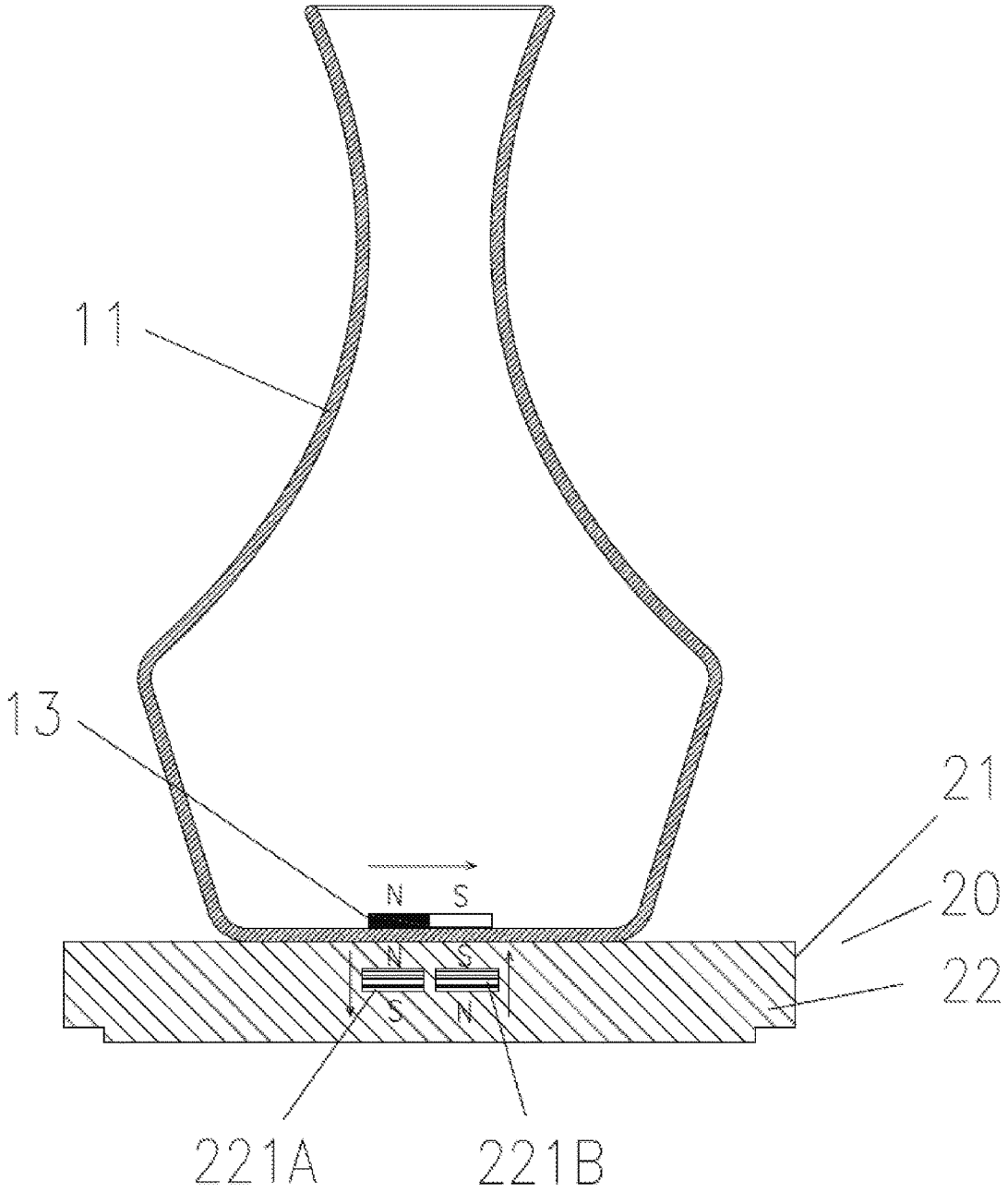
FIG. 4 is a schematic structural diagram of a variation manner of the decanter of FIG. 3.

The foregoing describes the present invention, but the present invention may further have some varied forms, for example:

Referring to FIG. 4, there are two coil windings, which are respectively 221A and 221B. Coil stacking directions of the coil windings 221A and 221B are perpendicular or approximately perpendicular to the upper surface 2101 of the housing 21. That is, directions of magnetic fields generated by the coil windings 221A and 221B when the coil windings 221A and 221B are powered on are also perpendicular or approximately perpendicular to the upper surface 2101 of the housing 21, or in other words, the direction of the magnetic field generated by the variation magnetic field generator 22 is axial. A horizontal distance between the coil windings 221A and 221B on the upper surface 2101 of the housing 21 should enable magnetic fields generated by them to cover the movement component 13. To make the movement component 13 rotate, directions of magnetic fields generated by the coil windings 221A and 221B at work are opposite. For example, at a particular moment, the coil winding 221A repels the N pole of the movement component 13, and the coil winding 221B attracts the N pole of the movement component 13.

Referring to FIG. 5, there may further be three, four, or more coil windings, which are distributed in a circumferential array. Directions of magnetic fields generated by adjacent coil windings are opposite, and the magnetic fields generated by them can cover the movement component 13.

Figure 7:
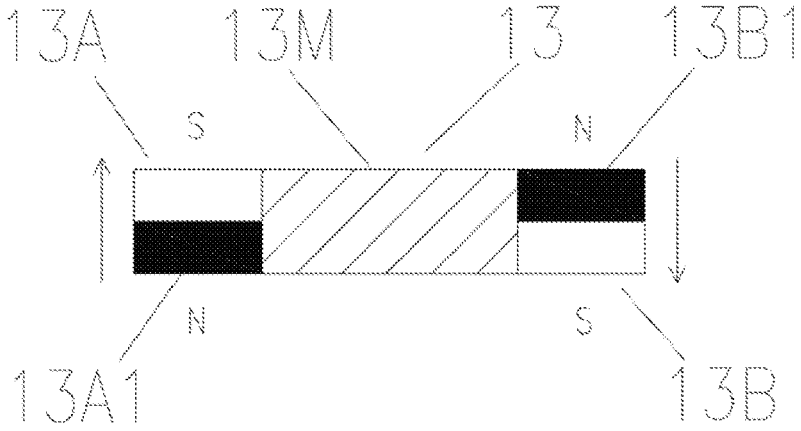
FIG. 7 is a schematic structural diagram of another variation manner of a movement component of the present invention.

Referring to FIG. 6, the movement component 13 may further be partially a permanent magnet. Specifically, two ends 13A and 13B of the movement component 13 are permanent magnets, and the middle 13M is a non-magnetic material. Magnetization directions of the permanent magnets on the two ends 13A and 13B may be along a length direction, or may be perpendicular to the length direction. Referring to FIG. 6, if the magnetization directions are along the length direction, the magnetization directions of the two ends 13A and 13B should be the same. From a general view, one end 13A of the movement component 13 is the N pole, and the other end 13B is the S pole. Referring to FIG. 7, if the magnetization directions are perpendicular to the length direction, the magnetization directions of the two ends 13A and 13B should be opposite. From a general view, a below 13A1 of one end 13A of the movement component 13 is the N pole, and a below 13B1 of the other end 13B is the S pole.

Shapes of the movement component 13 further include a disk shape, a cruciform, an X shape, and a pozidriv shape.

Figure 8:
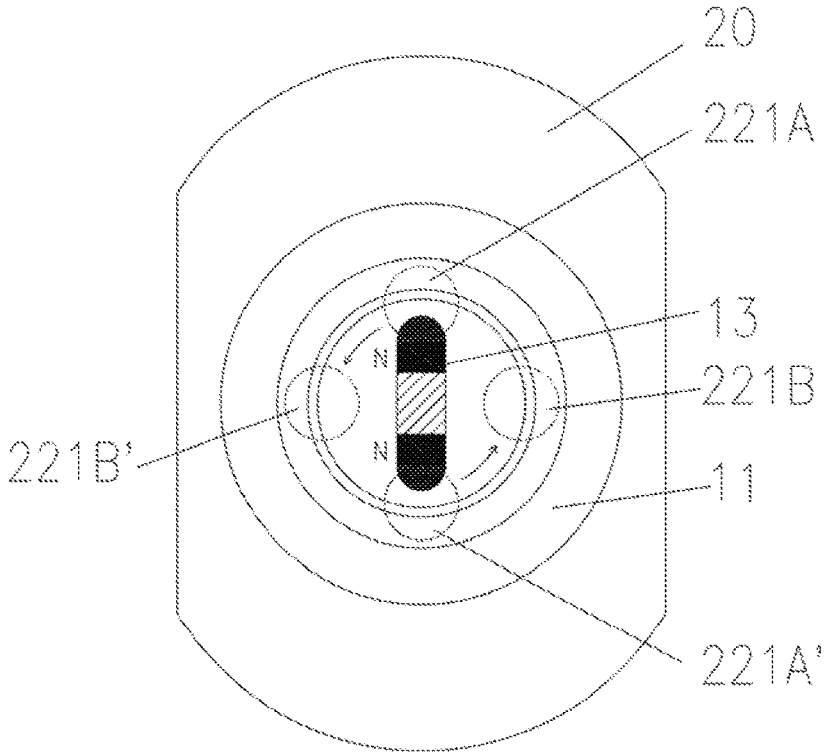
FIG. 8 is a schematic structural diagram of a third structure of a decanter of the present invention.
Figure 9:
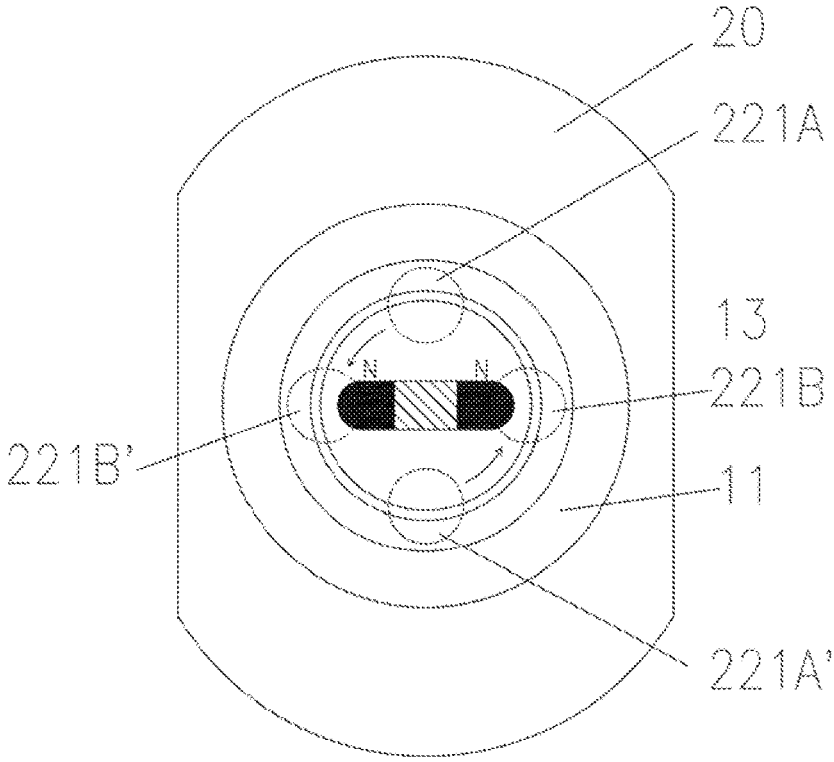
FIG. 9 is a schematic diagram of a variation state of the decanter of FIG. 8.

Referring to FIG. 8 and FIG. 9, in the present invention:

The variation magnetic field generator 22 generates magnetic fields with a varied magnetic field distribution.

The variation magnetic field generator 22 specifically includes a coil winding and a power supply circuit 224. Referring to FIG. 8 and FIG. 9, the movement component 13 is partially a permanent magnet. Specifically, referring to FIG. 6, the two ends 13A and 13B of the movement component 13 are permanent magnets, and the middle 13M is a non-magnetic material or a soft magnetic material.

Referring to FIG. 6, FIG. 8, and FIG. 9, polarities of the two ends 13A and 13B of the movement component 13 are the same. Magnetization directions of the permanent magnets on the two ends 13A and 13B may be along a length direction, or may be perpendicular to the length direction. If the magnetization directions are along the length direction, the magnetization directions of the two ends 13A and 13B should be opposite. From a general view, the polarities of the two ends 13A and 13B of the movement component 13 are the same, the two ends 13A and 13B are both N poles, or the two ends 13A and 13B are both S poles. If the magnetization directions are perpendicular to the length direction, the magnetization directions of the two ends 13A and 13B should be the same. From a general view, the polarities of two ends of the movement component 13 on a same surface are the same, are both N poles, or are both S poles.

Referring to FIG. 8, there are a total of four coil windings, which are respectively 221A, 221A', 221B, and 221B', and are disposed in the housing 21. Coil stacking directions of the four coil windings are perpendicular or approximately perpendicular to the upper surface 2101 of the housing 21, and directions of magnetic fields generated at work are the same. Polarities presented on the upper surface 2101 of the housing 21 are all the same, and are opposite to the polarities of the two ends of the movement component 13. Viewing down from the upper surface 2101 of the housing 21, the four coil windings are distributed in a cruciform, the coil windings 221A and 221A' are a first group of coil windings, and 221B and 221B' are a second group of coil windings.

Referring to FIG. 8, the first group of coil windings and the second group of coil windings alternatively work, so that distribution of magnetic fields generated by the two groups of coil windings changes, thereby making the movement component 13 move. Referring to FIG. 8, the first group of coil windings are powered on, and the movement component 13 with the same polarity on two ends is attracted to above the first group of coil windings. Referring to FIG. 9, the first group of coil windings are powered off, and magnetic fields generated by the first group of coil windings disappear; the second group of coil windings are powered on, and generated magnetic fields attract the movement component 13 from above the first group of coil windings to above the second group of coil windings, so that the movement component 13 rotates by 90 degrees in an anticlockwise manner; the second group of coil windings are powered off, and magnetic fields generated by the second group of coil windings disappear; the first group of coil windings are powered on, and generated magnetic fields attract the movement component 13 from above the second group of coil windings to above the first group of coil windings, and further make the movement component rotate by 90 degrees in an anticlockwise manner. By analogy, the movement component 13 rotates in the wine container 11 to make grape wine in the wine container 11 form a vortex, thereby generating a gas channel 100. External air enters the gas channel 100. The movement component 13 rotates in the wine container 11, and beats air entering the gas channel 100 into the grape wine. In this way, the grape wine in the wine container 11 constantly comes into contact with air, thereby implementing quick decanting.

The foregoing describes the present invention, but the present invention may further have some varied forms, for example:

The movement component 13 is partially a soft magnetic material. Specifically, the two ends 13A and 13B are soft magnetic materials, and a part of the middle 13M may further be a permanent magnet. A magnetization direction of the permanent magnet is perpendicular to a length direction of the movement component 13. Accordingly, a permanent magnet is also disposed in the middle of the variation magnetic field generator 22. The two permanent magnets are configured to position the movement component 13, and are equivalent to a rotation shaft of the movement component 13, so that the movement component 13 can better rotate.

The movement component 13 is entirely a soft magnetic material.

The number of the coil windings is an even number, and the coil windings are arranged in a circumferential array or an approximately circumferential array. The number may be six, eight, ten, or more, that is, a plurality of groups of coil windings that alternatively work are disposed.

According to the foregoing description, it can be learned that magnetic fields with a varied magnetic field distribution are generated by making different coil windings alternatively work, and the special thing thereof is that the energy consumption of the decanter can be reduced.

Figure 10:
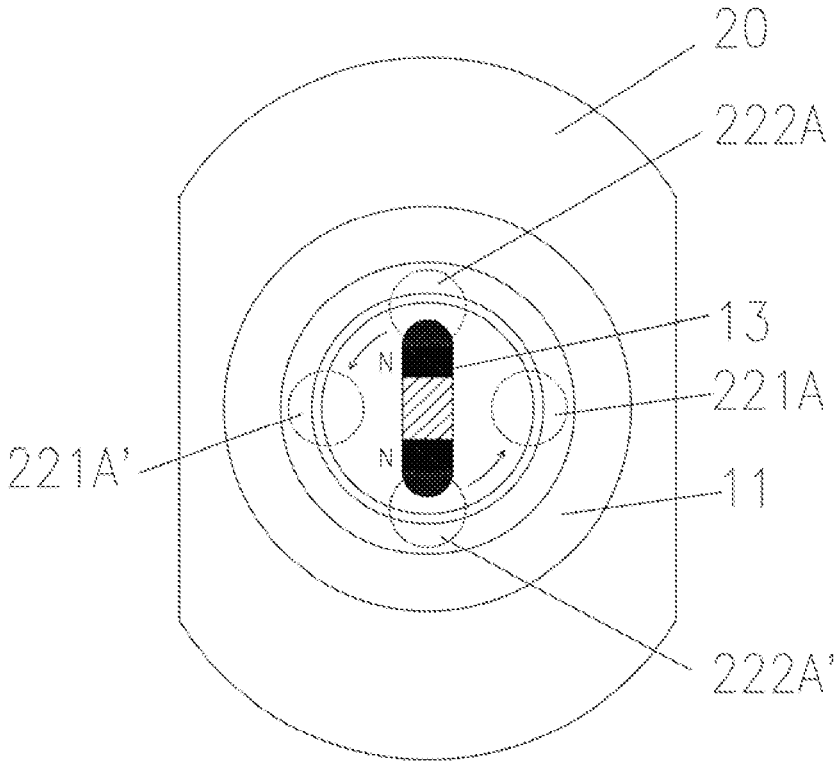
FIG. 10 is a schematic structural diagram of a fourth structure of a decanter of the present invention.

Referring to FIG. 10, in the present invention:

The variation magnetic field generator 22 generates a magnetic field with a varied magnetic field strength.

The variation magnetic field generator 22 not only includes a coil winding and a power supply circuit 224, but also includes a first permanent magnet.

There are two coil windings, which are respectively 221A and 221A'.

There are two first permanent magnets, which are sheet-shaped, and are respectively 222A and 222A'.

The polarities of the two ends of the movement component 13 are the same. Specifically, the movement component 13 is partially a permanent magnet. From a general view, the polarities of the two ends of the movement component 13 are the same.

The coil windings 221A and 221A' and the first permanent magnets 222A and 222A' are all disposed in the housing 21. Polarities presented by the magnetic fields generated by the coil windings and the first permanent magnets at work on the upper surface 2101 of the housing 21 are the same and are opposite to the polarities of the two ends of the movement component 13. The strengths of the magnetic fields generated by the coil windings 221A and 221A' after the coil windings 221A and 221A' are powered on are all stronger than those of the first permanent magnets 222A and 222A'.

Referring to FIG. 10, at an initial stage, due to an effect of magnetic fields of permanent magnets, heteropoles attract each other; the movement component 13 is located above the first permanent magnets 222A and 222A'; the coil windings 221A and 221A' work to generate magnetic fields with stronger strengths; the movement component 13 rotates from above the first permanent magnets 222A and 222A' in an anticlockwise manner to above the coil windings 221A and 221A'; the coil windings 221A and 221A' are powered off or generate magnetic fields weaker than those of the first permanent magnets 222A and 222A'; under a joint effect of rotary inertia and the magnetic fields of the first permanent magnets, the movement component 13 rotates from above the coil windings 221A and 221A' in an anticlockwise manner to above the first permanent magnets; then the coil windings 221A and 221A' work to generate magnetic fields with stronger strengths, to make the movement component 13 rotate. This cycle repeats, and the movement component 13 rotates in the grape wine, to form a gas channel in the grape wine, thereby implementing decanting.

The foregoing describes the present invention, but the present invention may further have some varied forms, for example:

The movement component 13 may further be entirely a soft magnetic material, such as pure iron or an iron-based nano material.

The movement component 13 is partially a magnetic material, which is disposed on two ends of the movement component 13.

There may further be four, six, or more coil windings.

There may further be four, six, or more first permanent magnets.

According to the foregoing description, it can be learned that magnetic fields with varied strengths are generated by using the coil windings and the first permanent magnets, and the special thing thereof is that the internal structure of the variation magnetic field generator can be simplified and the number of the coil windings can be reduced, so that the circuit structure of the power supply circuit is simplified, and an effect of reducing energy consumption is also achieved.

Figure 11:
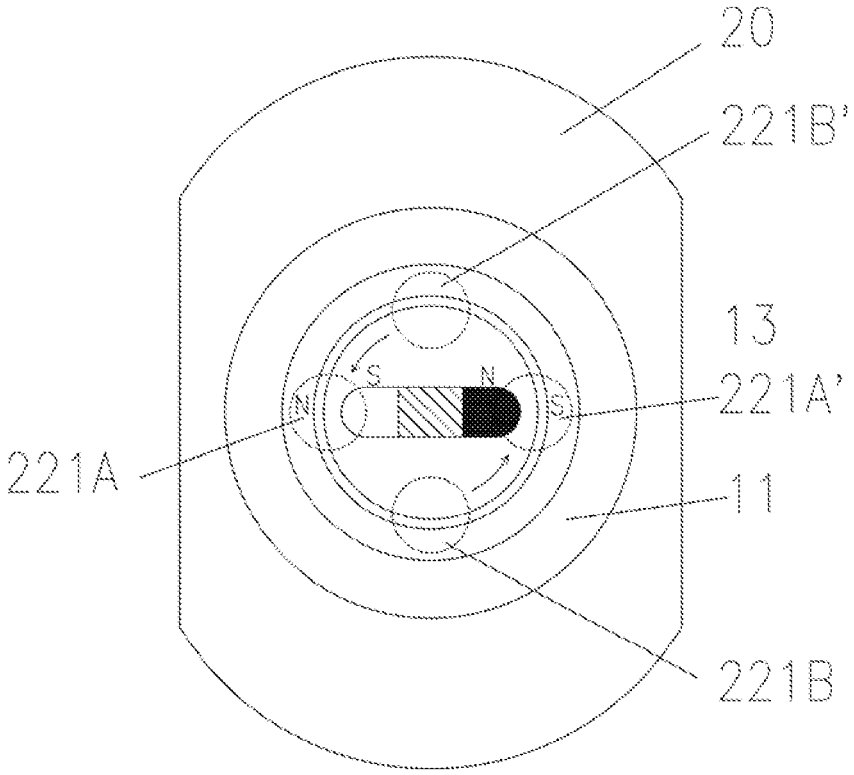
FIG. 11 is a schematic structural diagram of a fifth structure of a decanter of the present invention.

Referring to FIG. 11, in the present invention:

The variation magnetic field generator 22 generates magnetic fields with both a varied magnetic field direction and a varied magnetic field distribution.

The variation magnetic field generator 22 specifically includes a coil winding and a power supply circuit 224.

The polarities of the two ends of the movement component 13 are different, and specifically, the movement component 13 is entirely a permanent magnet.

There are four coil windings, which are respectively 221A, 221A', 221B, and 221B', and are disposed in the housing 21. Coil stacking directions of the four coil windings are perpendicular or approximately perpendicular to the upper surface 2101 of the housing 21. Viewing down from the upper surface 2101 of the housing 21, the four coil windings are in a cruciform. The coil windings 221A and 221A' are a first group of coil windings, and are disposed opposite to each other. Directions of magnetic fields generated at work are opposite. The coil windings 221B and 221B' are a second group of coil windings, and are also disposed opposite to each other. Directions of magnetic fields generated at work are also opposite.

Figure 12:
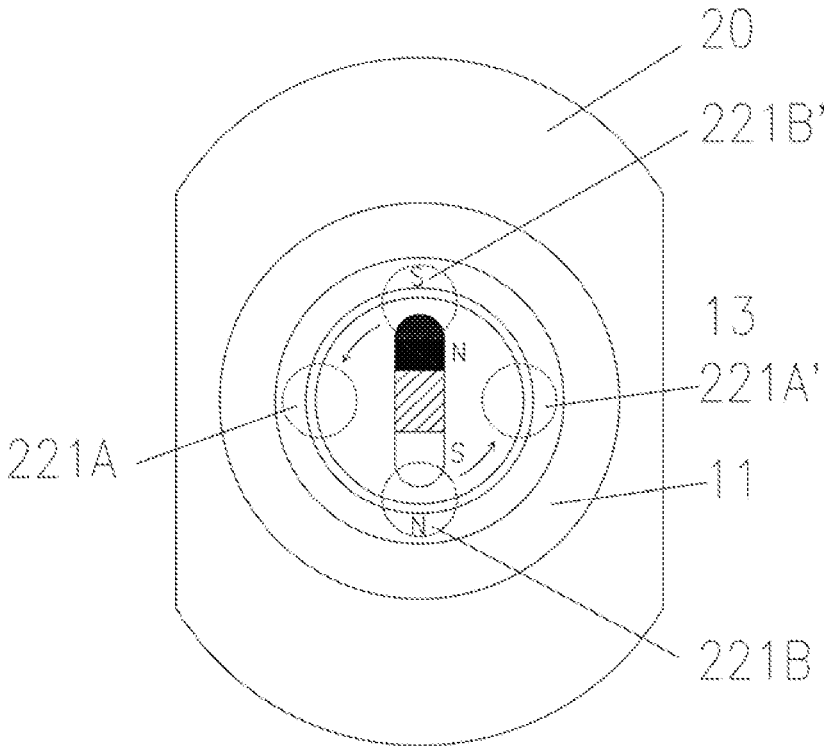
FIG. 12 is a schematic diagram of a variation state of the decanter of FIG. 11.

The first group of coil windings and the second group of coil windings alternatively work, so that directions and distribution of magnetic fields generated by them both change, thereby making the movement component 13 rotate. Referring to FIG. 11, in a first quarter of a period, the second group of coil windings do not work, the first group of coil windings are powered on, directions of magnetic fields generated by the coil windings 221A and 221A' are opposite, a direction of a magnetic field of the coil winding 221A on the upper surface 2101 of the housing 21 is the N pole, then a direction of a magnetic field of the coil winding 221A' is the S pole, and under the effect of magnetic fields, the movement component 13 is located above the first group of coil windings. Specifically, the S pole of the movement component 13 is located above the coil winding 221A, and the N pole of the movement component 13 is located above the coil winding 221A'. Referring to FIG. 12, in a second quarter of the period, the first group of coil windings do not work, the second group of coil windings are powered on, magnetic fields previously generated by the first group of coil windings disappear, magnetic fields are generated above the second group of coil windings, directions of magnetic fields generated by the coil windings 221B and 221B' are opposite, a direction of a magnetic field of the coil winding 221B on the upper surface 2101 of the housing 21 is the N pole, then a direction of a magnetic field of the coil winding 221B' is the S pole, the movement component 13 rotates by 90 degrees in an anticlockwise manner, and the S pole is located above the coil winding 221B. In a third quarter of the period, the second group of coil windings do not work, the first group of coil windings are powered on, and in this case, directions of magnetic fields generated by the coil windings 221A and 221A' are opposite to those in the first quarter of the period; the movement component 13 rotates by 90 degrees in an anticlockwise manner; the S pole is located above the coil winding 221A'. In a fourth quarter of the period, the first group of coil windings do not work, the second group of coil windings are powered on, directions of magnetic fields generated by the coil windings 221B and 221B' are opposite to those in the second quarter of the period; the movement component 13 then rotates by 90 degrees in an anticlockwise manner; the S pole is located above the coil winding 221B'. This cycle repeats, and the movement component 13 rotates in the grape wine, so that the gas channel 100 is formed in the grape wine, thereby implementing decanting.

The foregoing describes the present invention, but the present invention may further have some varied forms, for example:

The number of the coil windings is an even number, and the coil windings are arranged in a circumferential array or an approximately circumferential array. The number may be specifically six, eight, ten, or more.

Alternatively, only two ends of the movement component 13 may be permanent magnets.

According to the foregoing description, it can be learned that magnetic fields with both a varied magnetic field direction and a varied magnetic field distribution are generated by making different coil windings alternatively work, and the special thing thereof is that the energy consumption of the decanter can be reduced.

Based on the foregoing embodiment of the present invention, referring to FIG. 43, a control unit 225 may further be disposed. The control unit 225 is connected to the power supply unit 224. The control unit 225 is configured to change an output signal of the power supply circuit 224, so as to control a working state of the movement component 13. The control unit 225 may use an existing control circuit. Directions and strengths of magnetic fields generated by the magnetic field generator 22 can be changed by using the control unit 225. For example, the direction and the magnitude of current are controlled, to change the rotation direction and rotation speed of the movement component 13, so that forward and reverse rotation and acceleration and deceleration can be conveniently implemented, thereby accelerating the decanting process. In addition, because forward and reverse rotation of the movement component 13 can be implemented, the forward and reverse rotation of the movement component can be used to clean the wine container, to make the decanter multifunctional. The movement component 13 is enabled, by using magnetic fields, to rotate, and the movement component 13 can be constrained in space, to prevent the movement component 13 from deviating from a working position. For example, if the movement component 13 deviates from the working position, the magnitude of the force fields and magnetic fields can be enhanced, to make the movement component 13 return to the working position.

Figure 20:
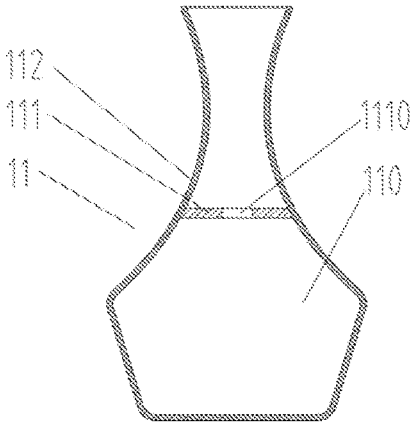
FIG. 20 is a schematic structural diagram of a wine container of the present invention.

The foregoing describes the present invention, but the present invention may further have some varied forms, for example:

The decanter 20 may also be located in an upper part of the wine container 11. Referring to FIG. 20, for example, the decanter 20 is sleeved on a neck part 112 of the wine container 11, the corresponding movement component 13 is placed in the neck part 112 of the wine container 11, and the decanter 20 drives, by using magnetic fields, the movement component 13 placed in the neck part 112 of the wine container 11.

The decanter 20 is processed into an annular shape, and the wine container 11 is placed in the middle of the annular decanter 20, that is, the annular decanter 20 encloses the wine container 11.

Figure 13:
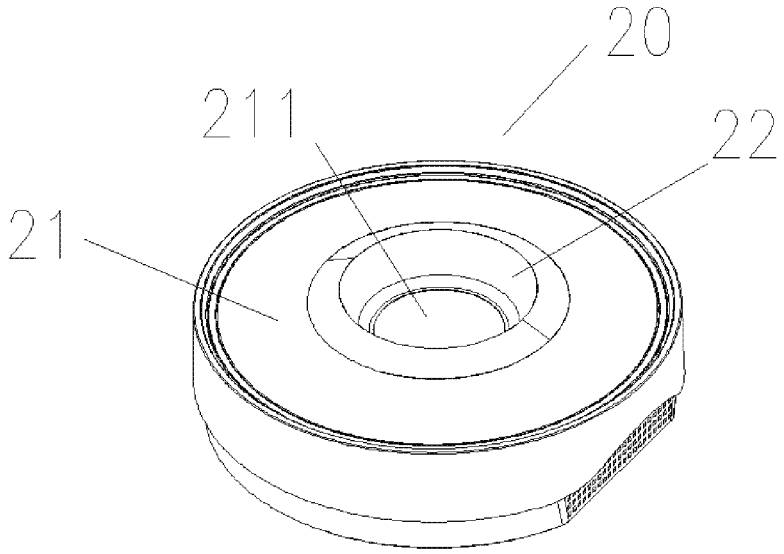
FIG. 13 is a schematic structural diagram of a sixth structure of a decanter of the present invention.

Referring to FIG. 13, directions of magnetic fields generated by the variation magnetic field generator 22 may also be radial; a recess 211 is disposed on the housing 21 for matching against the wine container 11; the variation magnetic field generator 22 is arranged along the inside of the recess 211, so as to generate radial magnetic fields to drive the movement component 13; directions of magnetic fields generated by the variation magnetic field generator 22 may also be a combination of axial and radial directions; for example, four coil windings are designed, directions of magnetic fields generated by two coil windings are axial, and directions of magnetic fields generated by other two coil windings are radial, thereby implementing a combination of axial and radial magnetic field directions.

Figure 14:
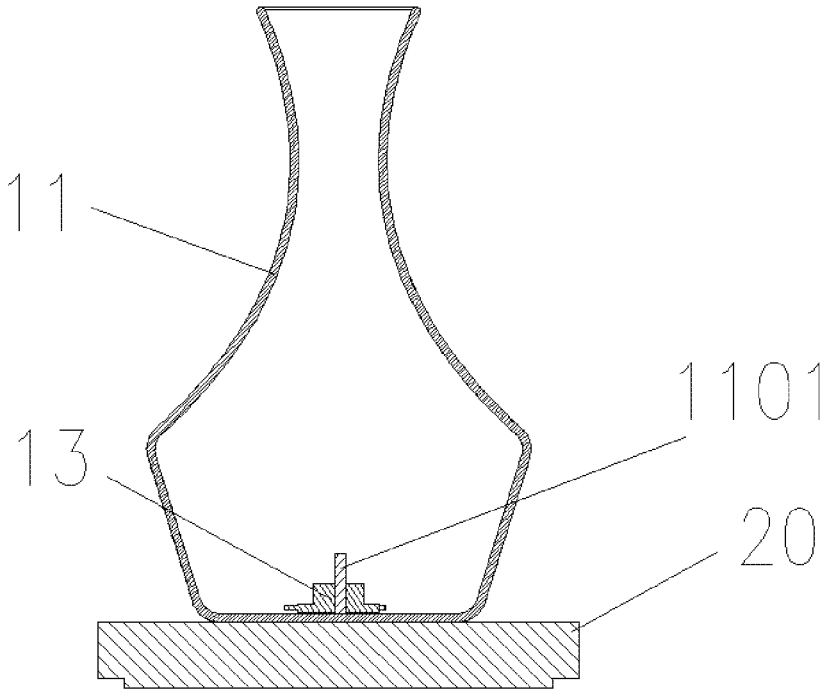
FIG. 14 is a schematic structural diagram of a variation manner of a decanting device of the present invention.

Referring to FIG. 14, a fixing shaft 1101 is disposed at the bottom of the wine container 11, the movement component 13 is sleeved on the fixing shaft 1101, and under the effect of magnetic fields, the movement component 13 rotates around the fixing shaft 1101.

Based on the foregoing embodiment of the present invention, the decanter 20 may also include a magnetic field adjustment unit. The magnetic field adjustment unit is connected to the housing 21 or disposed in the variation magnetic field generator 22. The magnetic field adjustment unit is configured to adjust distribution of magnetic fields. By means of adjustment of the distribution of magnetic fields, the movement component 13 that can sense a magnetic field moves to different locations in the wine for movement, to enhance a decanting effect. The magnetic field adjustment unit makes movement directions of the movement component 13 include a horizontal direction, a vertical direction, and a combination of a horizontal direction and a vertical direction.

Figure 15:
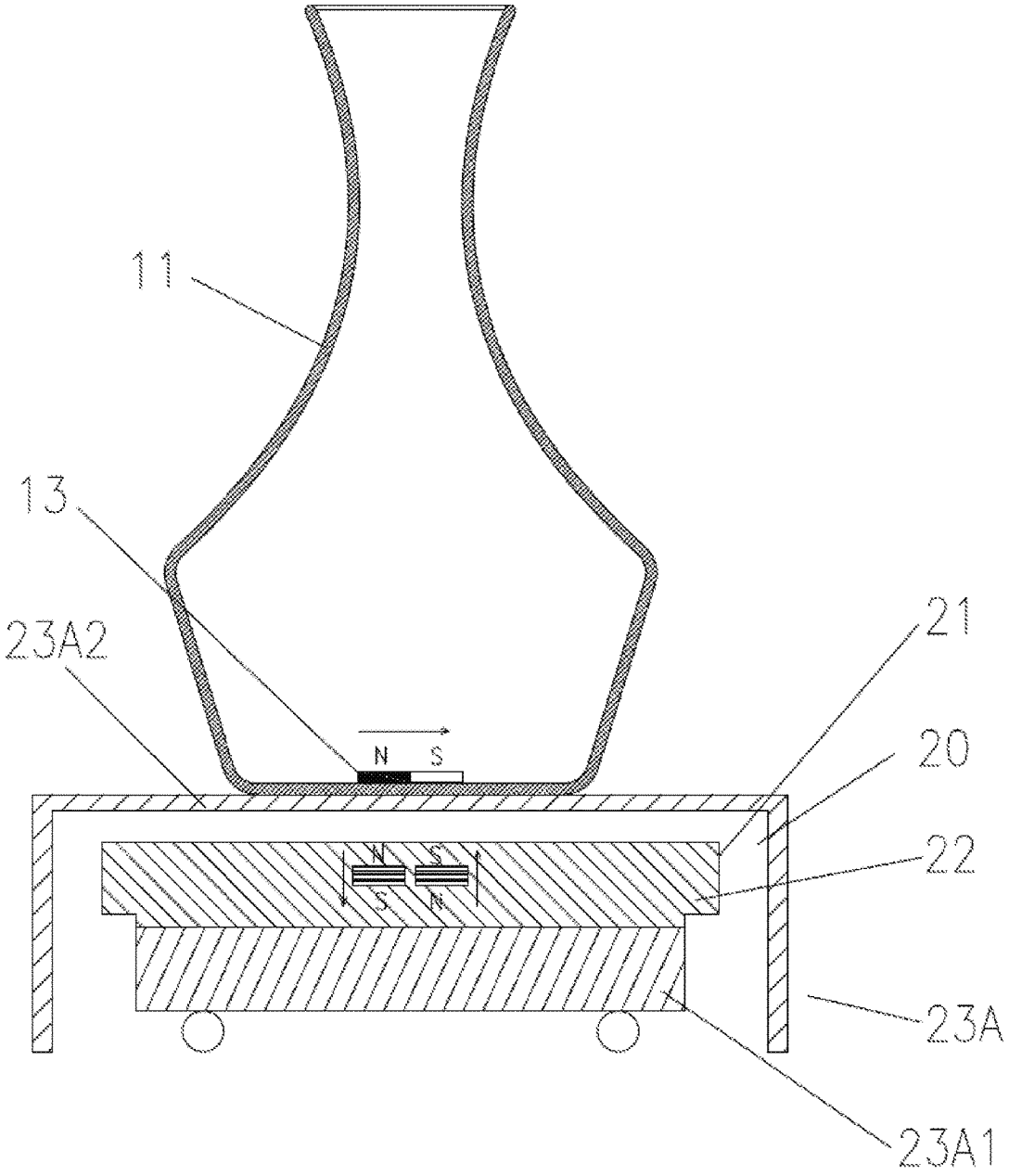
FIG. 15 is a schematic structural diagram of a magnetic field space distribution adjustment unit of the present invention.

Types of the magnetic field adjustment unit include a magnetic field space distribution adjustment unit and a magnetic field strength distribution adjustment unit. The magnetic field space distribution adjustment unit and the magnetic field strength distribution adjustment unit are respectively described in detail below:

Referring to FIG. 15, the magnetic field space distribution adjustment unit 23A is connected to the housing 21. Specifically, the housing 21 is placed on an upper surface of the magnetic field space distribution adjustment unit 23A. The magnetic field space distribution adjustment unit 23A is configured to change a spatial location of a magnetic field. Specifically, the magnetic field space distribution adjustment unit 23A includes a translation mechanism 23A1 and a supporting structure 23A2. The translation mechanism 23A1 is configured to move the housing 21. The supporting structure 23A2 is configured to support the wine container 11.

The translation mechanism 23A1 is a reciprocating translation mechanism. The reciprocating translation mechanism performs reciprocating translation movement on a plane, and drives the variation magnetic field generator 22 on the housing 21 to make reciprocating translation movement. In this way, magnetic fields generated by the variation magnetic field generator 22 also translate. Referring to FIG. 15, the wine container 11 is placed on the supporting structure 23A2 and is spaced from the upper surface 2101 of the housing 21. In addition to rotation, the movement component 13 also performs reciprocating translation movement with the housing 21, and translates to different locations in the grape wine for rotation, so as to form a vortex as a gas channel at different locations in the grape wine, and beats, at these locations, air entering the gas channel into the grape wine, to sufficiently implement decanting, thereby enhancing the decanting effect and accelerating the decanting speed.

The translation mechanism may also be a rotation translation mechanism, and drives the housing 21 to make circumferential movement, so that magnetic fields generated by the variation magnetic field generator 22 make circumferential movement, thereby making the movement component 13 also make circumferential movement in the grape wine, and rotate at different locations in the grape wine.

Figure 16:
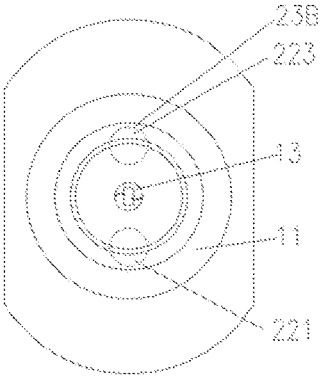
FIG. 16 is a schematic structural diagram of a seventh structure of a decanter of the present invention.
Figure 17:
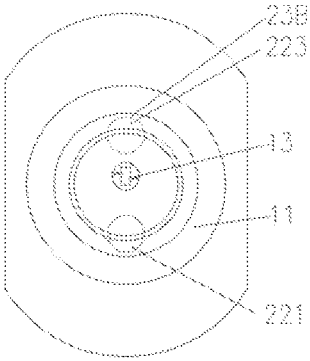
FIG. 17 is a use variation state diagram of FIG. 16.
Figure 44:
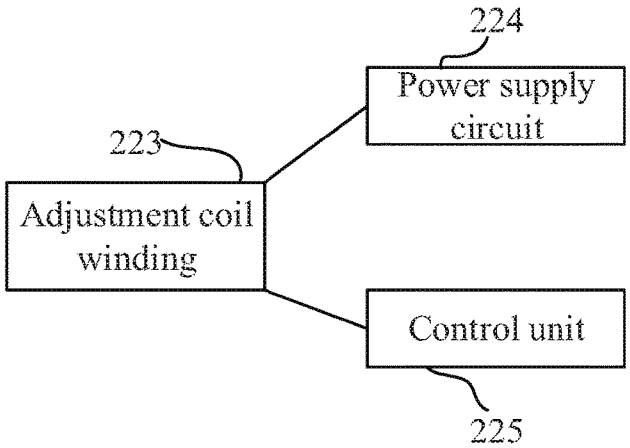
FIG. 44 is a schematic structural diagram of a circuit of a magnetic field strength distribution adjustment unit of the present invention.

Referring to FIG. 16 and FIG. 44, the magnetic field strength distribution adjustment unit 23B is disposed in the variation magnetic field generator 22. Referring to FIG. 44, the magnetic field strength distribution adjustment unit 23B includes a control unit 225, a power supply circuit 224, and an adjustment coil winding 223. The control unit 225 is configured to send a control signal to the power supply circuit 224. The adjustment coil winding 223 is connected to the power supply circuit 224. The control signal can control strengths of magnetic fields generated by the adjustment coil winding 223. Referring to FIG. 16, the variation magnetic field generator 22 is provided with two coil windings, which are respectively the coil winding 221 and the adjustment coil winding 223. The movement component 13 rotates between the coil winding 221 and the adjustment coil winding 223, to make grape wine in the wine container 11 rotate. When the movement component 13 needs to be moved in the grape wine, the control unit 225 sends a control signal to the power supply circuit 224, and the power supply circuit 224 separately supplies power to the coil winding 221 and the adjustment coil winding 223. Current of the adjustment coil winding 223 is greater than current of the coil winding 221. In this way, the strength of a magnetic field of the adjustment coil winding 223 is stronger than that of the coil winding 221. The coil winding 221 and the adjustment coil winding 223 form a non-uniform magnetic field. Under the effect of a magnetic field force of this non-uniform magnetic field, referring to FIG. 17, the movement component 13 that originally rotates between the coil winding 221 and the adjustment coil winding 223 translates to the side biased towards the adjustment coil winding 223, and continues rotating, so that a gas channel for gas inlet is generated at a current location. Air in the gas channel is beat into the grape wine by the movement component 13, thereby implementing decanting. According to requirements, the magnitude of current of the coil winding 221 and the magnitude of current of the adjustment coil winding 223 are controlled, so that magnetic fields generated by them change, to control a movement track of the movement component 13, thereby making the movement component 13 rotate at different locations of the wine container 11, making vortexes generated at these locations, forming a gas channel for external air inlet, and making decanting more sufficient.

Figure 18:
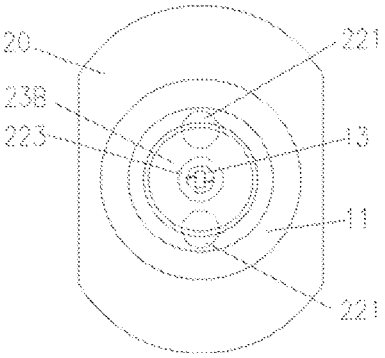
FIG. 18 is a schematic structural diagram of a variation manner of a magnetic field strength distribution adjustment unit of a decanter of the present invention.

Referring to FIG. 18 and FIG. 44, the magnetic field strength distribution adjustment unit 23B may also be set in the following manner: the adjustment coil winding 223 is disposed in the middle of the decanter 20, and an axial magnetic field can be generated by using the power supply circuit 224. There are two coil windings 221, which are distributed on two sides of the adjustment coil winding 223. Because the movement component 13 is a magnetic field sensing component, in addition to rotating in wine due to an effect of the magnetic fields generated by the two coil windings 221, the movement component 13 moves in a vertical direction under the effect of an axial magnetic field generated by the adjustment coil winding 223. If the movement component 13 is repelled by a magnetic field force, the movement component 13 moves upwards, and if the movement component 13 is attracted by the magnetic field force, the movement component 13 moves downwards. The control unit 225 can make the movement component 13 perform reciprocating movement in the vertical direction, and control displacement and movement speeds of the movement component 13. In this way, the movement component 13 rotates at different locations of the wine container 11, vortexes are generated at these locations, and a gas channel for external air inlet is formed, thereby making decanting more sufficient.

The movement component 13 can also be made, by using the magnetic field strength distribution adjustment unit 23B, to move in both a horizontal direction and a vertical direction, so that the movement component 13 moves to any location in the wine container 11. This can be implemented by disposing a plurality of adjustment coil windings. One makes the movement component 13 move in the horizontal direction, and the other makes the movement component 13 move in the vertical direction.

In cases in which there are three, four, five, or more coil windings 221, the magnetic field strength distribution adjustment unit 23B may also be disposed, and the principle thereof is the same as the foregoing principle.

The number of adjustment coil windings 23 may also be set to two, three, four, or more. In this way, by controlling the magnitude of magnetic fields generated by the adjustment coil windings, movement tracks of the movement component 13 can be diversified, to achieve a better decanting effect.

Figure 45:
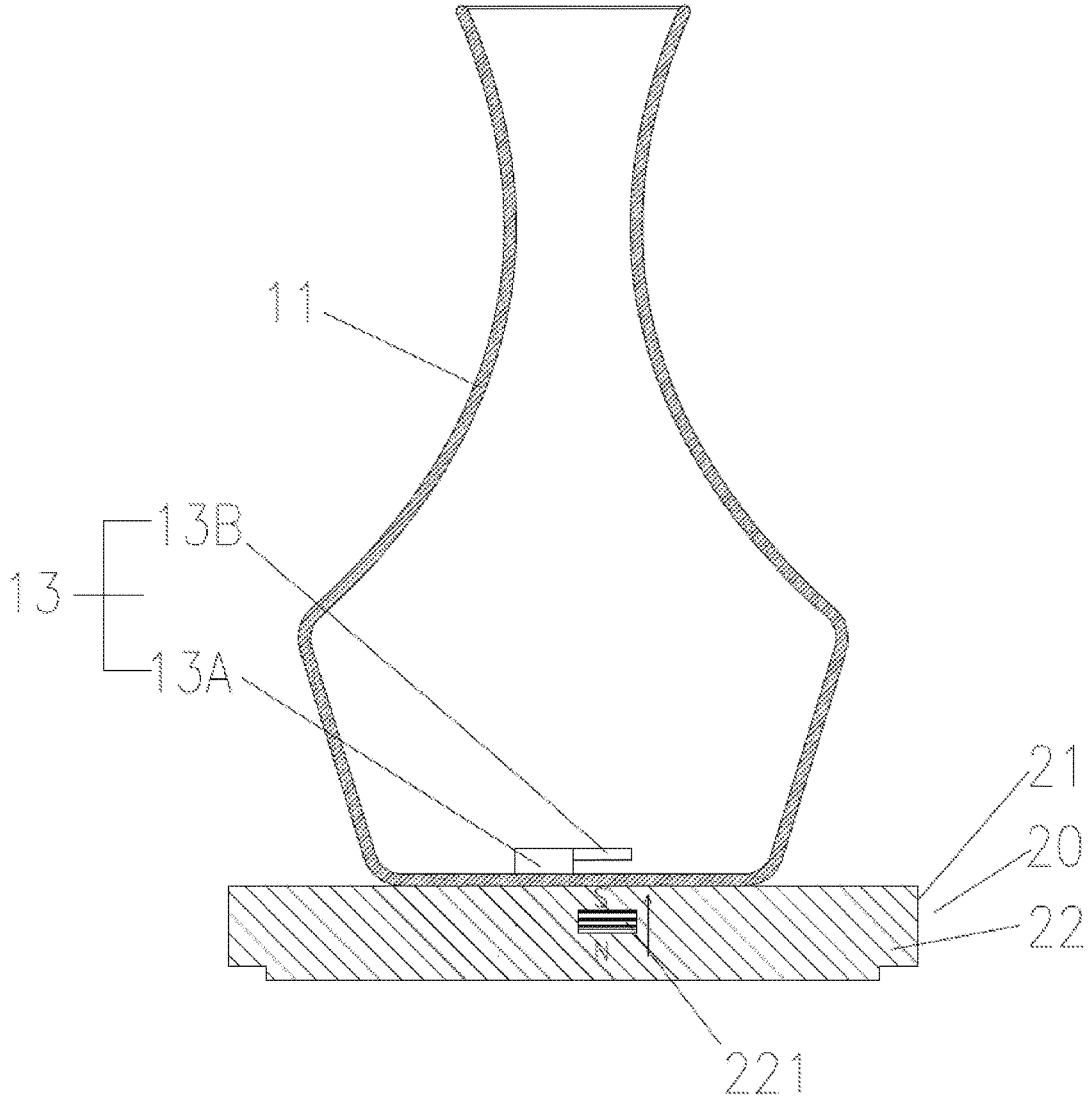
FIG. 45 is an overall schematic structural diagram of a decanting device of the present invention when a vibratile movement component is used in the decanting device.

Based on the foregoing description, in the present invention, a movement form of the movement component 13 in the grape wine may also be vibration:

Referring to FIG. 45, the movement component 13 is an elastic piece having magnetism; the movement component 13 is disposed in a form of a cantilever beam in the wine container 11; one end 13A is fixed, for example, is fixed at the bottom of the wine container 11 by using a magnetic field force, and the other end 13B is movable. The coil winding 221 is located below one end 13B of the movement component 13; at work, the coil winding 221 generates an axial magnetic field perpendicular or approximately perpendicular to the upper surface 2101 of the decanter 20; the magnetic field attracts one end 13B of the movement component 13 downwards; at a next moment, the magnetic field disappears; one end 13B of the movement component 13 returns to the original location under the effect of an elastic force; this cycle repeats, and the movement component 13 vibrates in the wine container 11, so that the grape wine in the wine container 11 moves. The change frequency of the magnetic field generated by the variation magnetic field generator 22 is amplified, so that the movement component 13 vibrates quickly enough, thereby forming, in the grape wine, a gas channel 100 for air inlet. The air comes into contact with the movement component 13 by using the gas channel 100. Under vibration of the movement component 13, the air is beat into the grape wine, thereby accelerating the decanting speed and enhancing the decanting effect.

Figure 46:
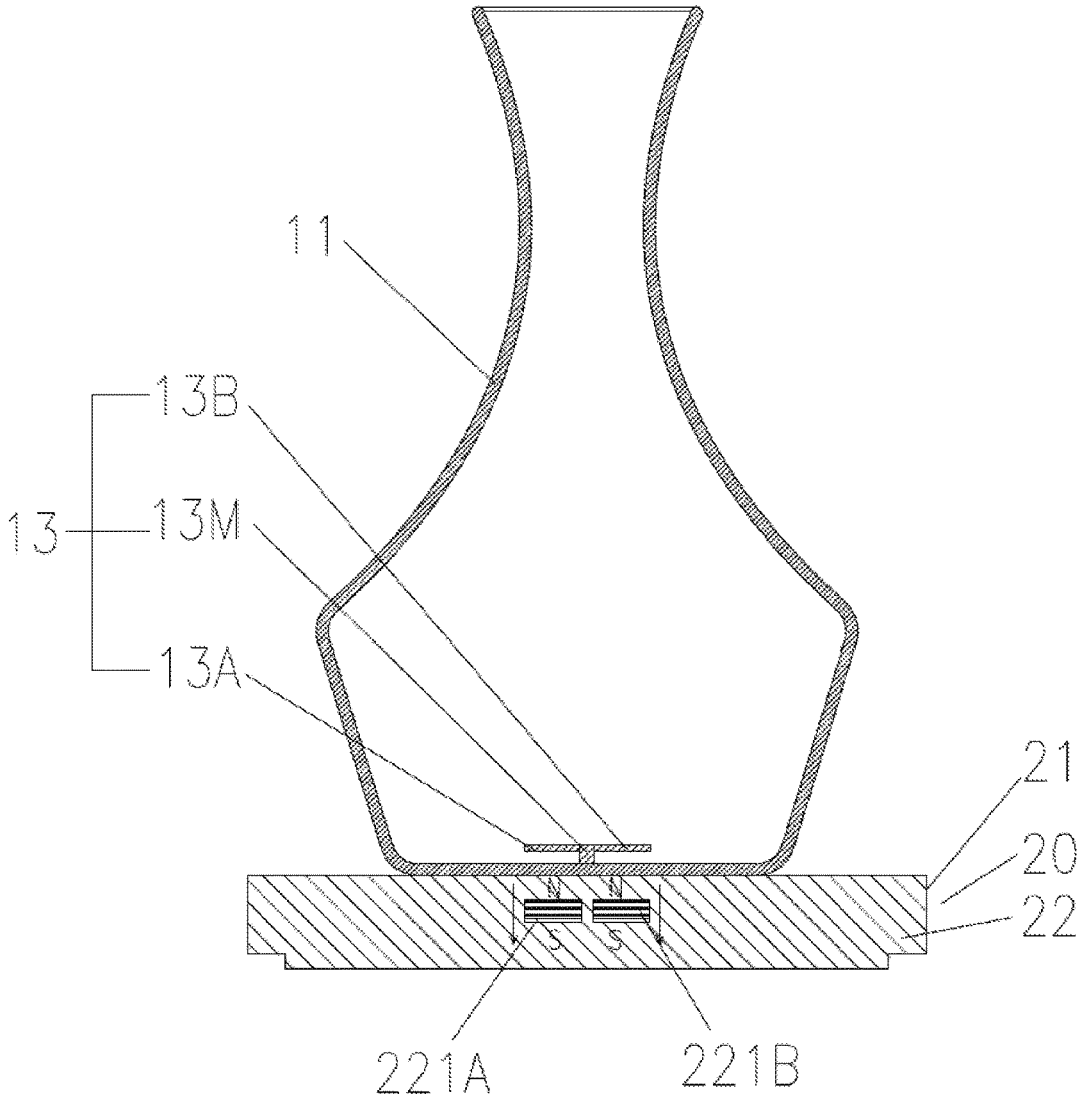
FIG. 46 is a schematic structural diagram of a variation manner of a decanting device of the present invention when a vibratile movement component is used in the decanting device.

In addition, referring to FIG. 46, the movement component 13 may also be set in the following manner: the middle 13M of the movement component 13 is fixed, and the two ends 13A and 13B are both movable. There are two coil windings, which are respectively 221A and 221B. The coil winding 221A is located below one end 13A of the movement component 13, and the coil winding 22B is located below one end 13B of the movement component 13. Similar to the case of FIG. 45, the coil windings 221A and 221B generate axial magnetic fields perpendicular or approximately perpendicular to the upper surface 2101 of the decanter 20. The coil winding 221A acts on one end 13A of the movement component 13, and the coil winding 221B acts on one end 13B of the movement component 13. Under the effect of a magnetic field, the two ends 13A and 13B of the movement component 13 both vibrate, to make grape wine move, thereby implementing decanting.

The movement component 13 is an elastic piece having magnetism. The elastic piece moves along a change direction of the magnetic field, and is more easily located at an optimal location of a magnetic line, thereby making the present invention more easily implemented. A plurality of movement components 13 may also be disposed, and each movement component 13 is separately controlled, so that grape wine at different locations moves, or the grape wine moves in different movement manners, thereby achieving a better decanting effect.

Based on the foregoing description, in the present invention, a movement form of the movement component 13 in the grape wine may also be translation:

Specific forms of translation include horizontal movement and vertical movement.

Figure 47:
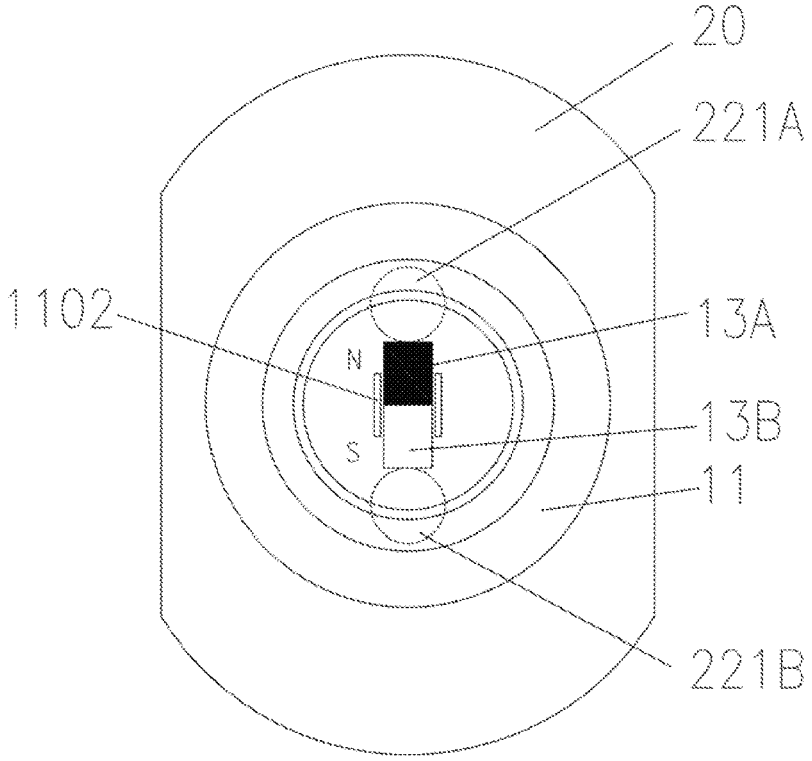
FIG. 47 is an overall schematic structural diagram of a decanting device of the present invention when a movement component that can horizontally move is used in the decanting device.
Figure 48:
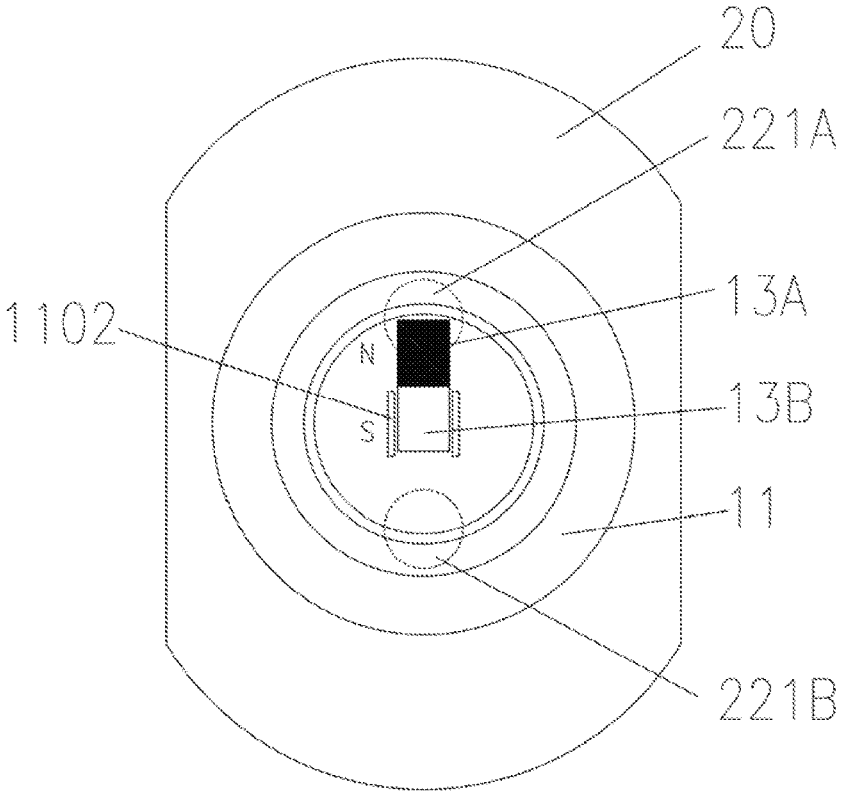
FIG. 48 is a use state diagram of FIG. 47.
Figure 49:
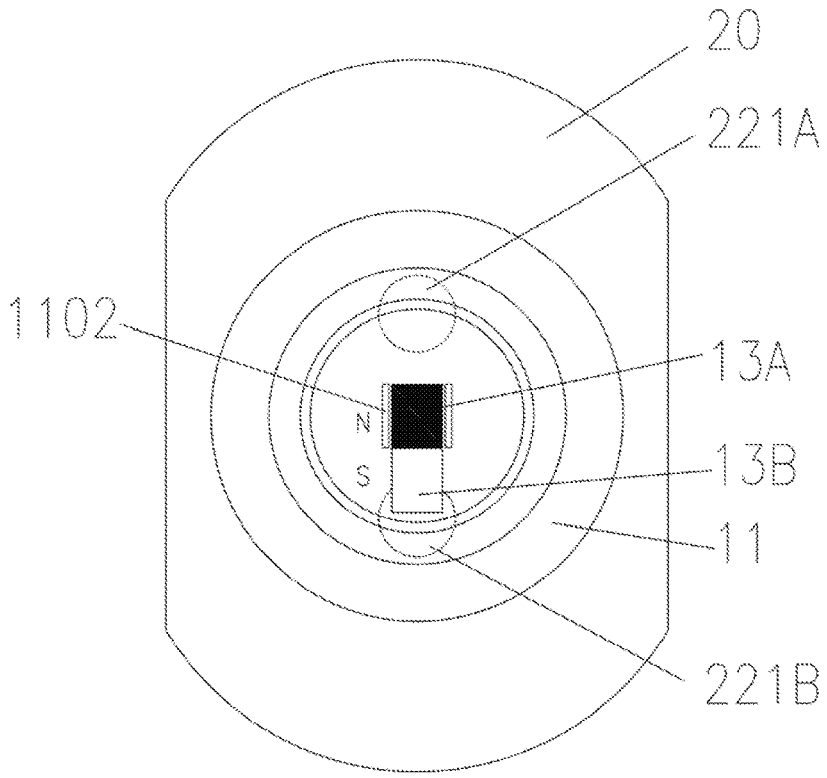
FIG. 49 is another use state diagram of FIG. 47.

Referring to FIG. 47, horizontal movement of the movement component 13 in grape wine can be implemented in the following manner: polarities of the two ends 13A and 13B of the movement component 13 are different, and are respectively N and S poles. The movement component 13 can be disposed at the bottom of the wine container 11 in a horizontal moving manner. For example, a slide groove 1102 is disposed at the bottom of the wine container 11 for limiting the movement component 13 to move upwards in a horizontal direction. The movement component 13 is placed in the slide groove 1102, and can horizontally move in the slide groove 1102. There are two coil windings, which are respectively 221A and 221B. The coil windings 221A and 221B generate axial magnetic fields perpendicular or approximately perpendicular to the upper surface 2101 of the decanter 20. The movement component 13 is located between the coil windings 221A and 221B. The magnetic field generated by the coil winding 221A attracts one end 13A of the movement component 13, and the magnetic field generated by the coil winding 221B attracts one end 13B of the movement component 13. Referring to FIG. 48, when the coil winding 221A generates a magnetic field, the coil winding 221B does not generate a magnetic field or generates a magnetic field weaker than that of the coil winding 221A; under the effect of the magnetic field generated by the coil winding 221A, one end 13A of the movement component 13 is attracted to the side of the coil winding 221A. Referring to FIG. 49, when the coil winding 221B generates a magnetic field, the coil winding 221A does not generate a magnetic field or generates a magnetic field weaker than that of the coil winding 221B; under the effect of the magnetic field generated by the coil winding 221B, one end 13B of the movement component 13 is attracted to the side of the coil winding 221B. This cycle repeats, and horizontal movement of the movement component 13 in the grape wine can be implemented, to make the grape wine move, thereby implementing decanting.

Figure 50:
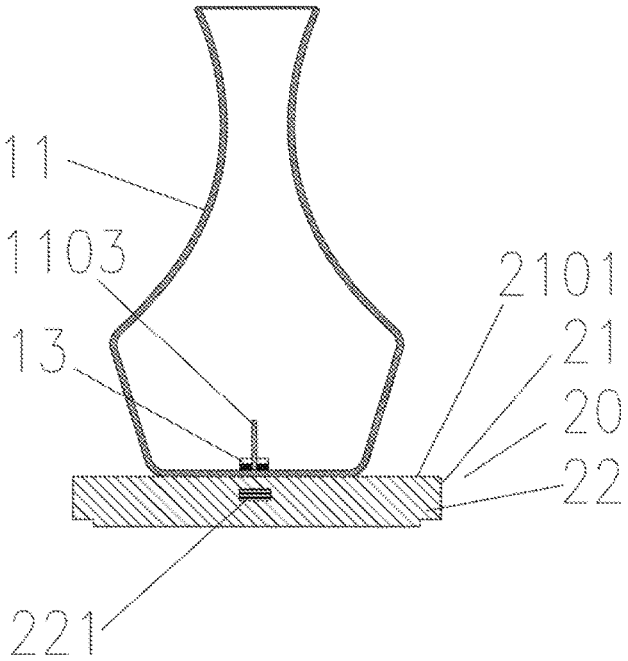
FIG. 50 is an overall schematic structural diagram of a decanting device of the present invention when a movement component that can vertically move is used in the decanting device.
Figure 51:
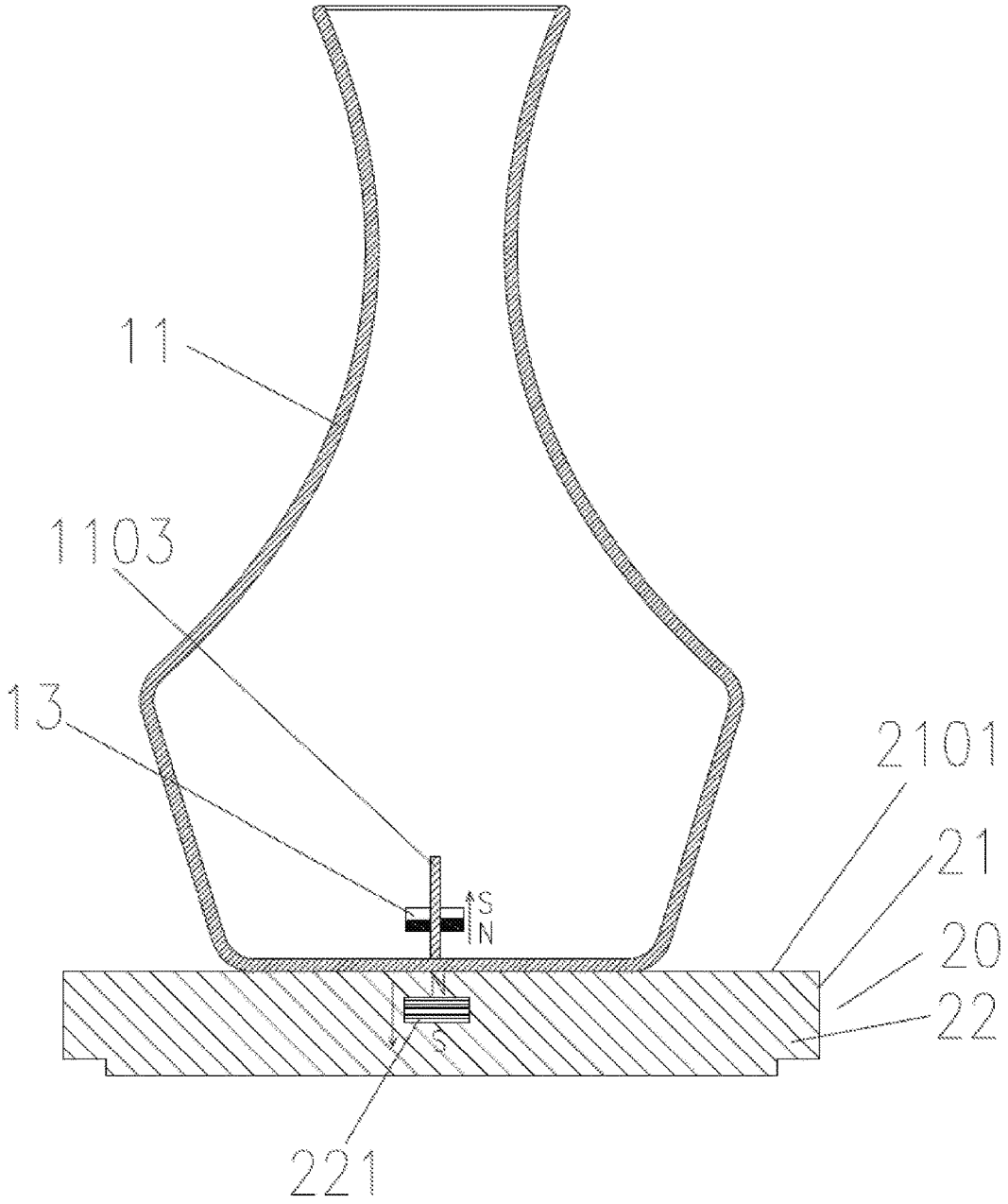
FIG. 51 is a use state diagram of FIG. 50.

Referring to FIG. 50, vertical movement of the movement component 13 in the grape wine can be implemented in the following manner: the movement component 13 may be disposed at the bottom of the wine container 11 in a vertical moving manner, and specifically, a shaft 1103 may be disposed at the bottom of the wine container 11; the movement component 13 is sleeved in the shaft; or a vertical guide rail is disposed at the bottom of the wine container 11, and the movement component 13 is disposed on the vertical guide rail. The movement component 13 is a magnetic body, and polarities of upper and lower surfaces thereof are different. The coil winding 221 is located below the movement component 13. The coil winding 221 generates an axial magnetic field perpendicular or approximately perpendicular to the upper surface 2101 of the decanter 20, and a direction of the magnetic field periodically changes. Referring to FIG. 51, at an initial stage, the movement component 13 is located at the bottom of the wine container 11, the coil winding 221 generates a magnetic field, and repels a lower surface of the movement component 13; the movement component 13 moves upwards along the shaft 1103 or the vertical guide rail; at a next moment, a magnetic field generated by the coil winding 221 attracts the lower surface of the movement component 13, and the movement component 13 moves downwards; this cycle repeats, so that vertical movement of the movement component 13 in the grape wine is implemented, to make the grape wine move, thereby implementing decanting.

Figure 19:
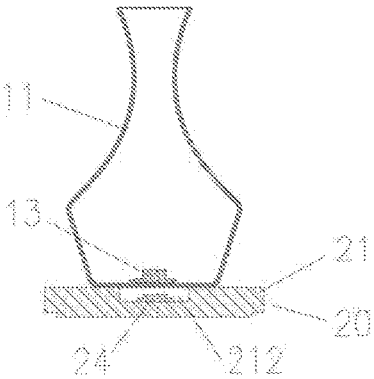
FIG. 19 is a schematic structural diagram of another variation manner of a decanting device of the present invention.

Referring to FIG. 19, based on the foregoing embodiment of the present invention, the present invention may also be implemented in the following manner: the decanter 20 further includes a driven rotor 24; the housing 21 is provided with a rotation space 212, and the driven rotor 24 is placed in the rotation space 212. The driven rotor 24 is a force field sensing component, and is specifically a magnetic field sensing component. At least one of the movement component 13 and the driven rotor 24 can generate a magnetic field. The wine container 11 is placed on the decanter 20, and is specifically placed on the rotation space 212. At work, the force field generator 22 generates a field force to drive the driven rotor 24, which rotates in the rotation space 212. Under driving, specifically, rotation and driving by a magnetic force, of the driven rotor 24, the movement component 13 in the wine container 11 also rotates, to make the grape wine in the wine container 11 rotate, to form a gas channel 100, thereby implementing decanting.

Figure 21:
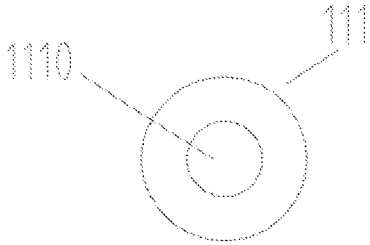
FIG. 21 is a schematic structural diagram of a top cover of a wine container of the present invention.
Figure 22:
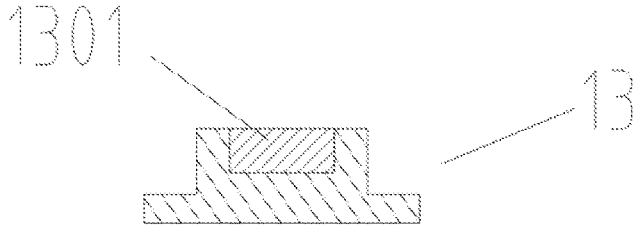
FIG. 22 is a schematic structural diagram of a movement component of the present invention.

Referring to FIG. 20 to FIG. 22, a movement space 110 is disposed in the wine container 11 of the present invention. A top cover 111 is disposed on top of the movement space 110 and is provided with a picking and placing port 1110. The movement space 110 is used to accommodate the movement component 13, which is a force field sensing component. Specifically, the wine container 11 is a glass container. Referring to FIG. 20, the top cover 111 is disposed on the neck part 112 of the wine container 11; the top cover 111 is fixed on an inner wall of the neck part 112; in the wine container 11, a space below the top cover 111 is the movement space 110, and the shape of the picking and placing port 1110 is circular.

Figure 23:
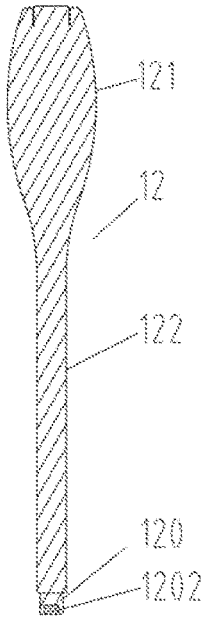
FIG. 23 is a schematic structural diagram of a picking and placing component of the present invention.
Figure 24:
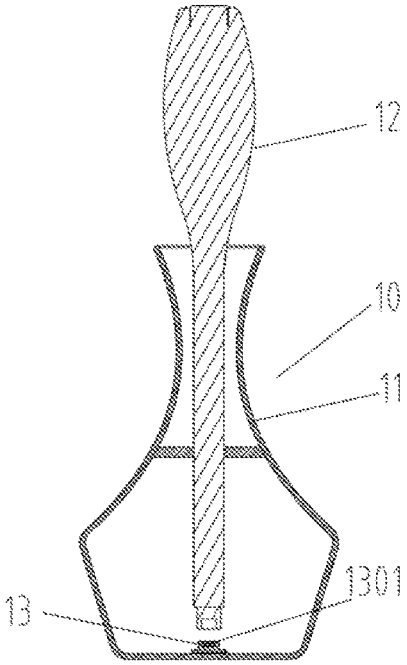
FIG. 24 is a schematic structural diagram of a decanting assembly of the present invention.

Referring to FIG. 20, FIG. 23, and FIG. 24, one end of the picking and placing component 12 of the present invention is provided with an attraction component 120; the attraction component 120 is connected to the picking and placing port 1110 of the wine container 11 in a matching manner for cooperative use, and the attraction component 120 is a force field sensing component. Specifically, the picking and placing component 12 is bar-shaped, and includes a handle 121, a bar body 122, and the attraction component 120; the handle 121 and the bar body 122 are integrally formed; the attraction component 120 is disposed on a lower end of the bar body 122; sectional shapes of the attraction component 120 and the bar body 122 are both similar to that of the picking and placing port 1110 of the wine container 11, and the sizes are both slightly less than that of the picking and placing port 1110, to facilitate accommodation into the picking and placing port 1110. Referring to FIG. 23, the attraction component 120 is a magnetic field sensing component, and a second magnetic component 1202 is disposed in the attraction component 120, and is a permanent magnet.

Figure 25:
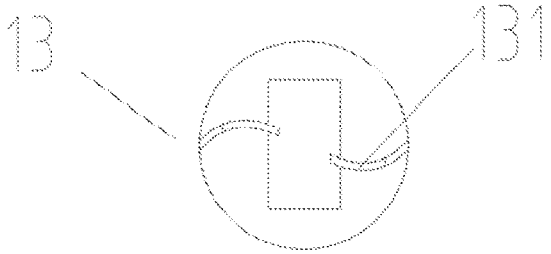
FIG. 25 is a schematic structural diagram of a variation manner of a movement component of the present invention.

Referring to FIG. 24, the present invention provides a decanting assembly 10, including the wine container 11 and the picking and placing component 12, and further including the movement component 13; the movement component 13 is placed in the movement space 110; the size of an outer profile of the movement component 13 is slightly less than the size of an inner ring of the picking and placing port 1110, so that the movement component 13 can be picked from and placed into the picking and placing port 1110. Specifically, the movement component 13 is a rotation component to make wine rotate and generate a vortex for accelerating decanting. Referring to FIG. 22, the movement component 13 is a magnetic field sensing component; a first magnetic component 1301 is disposed in the movement component 13; the first magnetic component 1301 is a permanent magnet, and the appearance of the movement component 13 is similar to that of the picking and placing port 1110 of the wine container 11. Referring to FIG. 25, a fan blade 131 is disposed on the movement component 13 and drives wine to rotate when the movement component 13 rotates, so that a vortex is generated in the wine, and a gas channel for external air inlet is formed.

Figure 26:
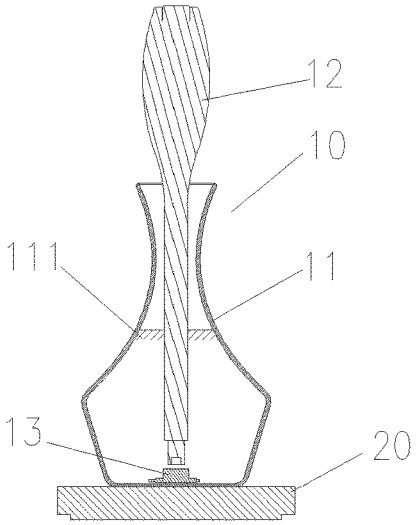
FIG. 26 is a schematic structural diagram of another variation manner of a decanting device of the present invention.

Referring to FIG. 26, after the wine in the wine container 11 is drunk, the picking and placing component 12 is extended into the picking and placing port 1110; when the attraction component 120 approaches to the movement component 13, under the effect of a magnetic field force, the movement component 13 is attracted onto the attraction component 120, and the movement component 13 can be taken out of the wine container 11 after the picking and placing component 12 is drawn out.

According to the foregoing description, it can be learned that in the present invention, the movement space 110 is disposed in the wine container 11; the movement component 13 is placed in the movement space 110; both the movement component 13 and the attraction component 120 are force field sensing components, and are specifically magnetic field sensing components; the attraction component 120 of the picking and placing component 12 matches against the picking and placing port 1110 of the wine container 11, so that under the effect of a magnetic field force, the movement component 13 is attracted onto the attraction component 120, so that the movement component 13 is taken out of the wine container 11 and the operation is convenient. Moreover, the movement space 110 is disposed in the wine container 11, which is an integral structure, and does not need to be sealed, and has no problem of liquid leakage.

Figure 27:
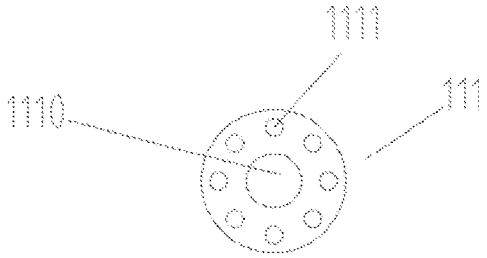
FIG. 27 is a schematic structural diagram of a variation manner of a top cover of the present invention.

The foregoing embodiment describes the present invention, but the present invention may further have some varied forms, for example:

Referring to FIG. 27, the top cover 111 is provided with a liquid guide hole 1111, to make it convenient for the wine in the wine container 11 to enter the movement space 110, so that the wine comes into contact with the movement component 13, and rotates under driving of the movement component 13, thereby accelerating the decanting process.

Figure 28:
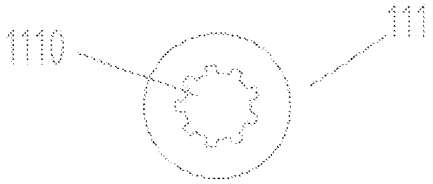
FIG. 28 is a schematic structural diagram of a variation manner of a picking and placing port of the present invention.

Referring to FIG. 28, the shape of the picking and placing port 1110 may also be knurl-shaped, and the shapes of the picking and placing port 1110 also include oval, polygonal, and irregular shapes; the shapes of the outer profiles of the movement component 13 and the attraction component 120 are similar to that of the picking and placing port 1110, but the sizes are both slightly less than the size of the inner ring of the picking and placing port 1110.

The shapes of the picking and placing component 12 also include a bar shape and a strip shape.

The force field sensing component may also be an electric field sensing component.

The second magnetic component 1202 may also be an electromagnet.

Figure 29:
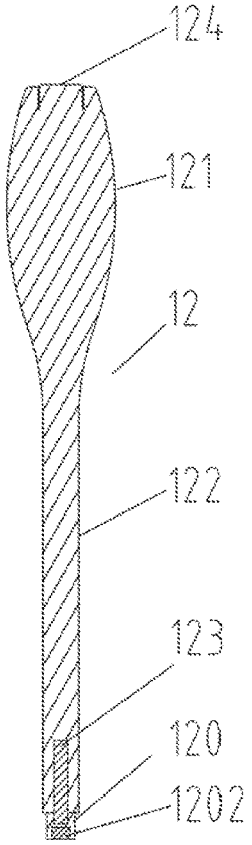
FIG. 29 is a schematic structural diagram of a variation manner of a picking and placing component of the present invention.

Referring to FIG. 29, the picking and placing component 12 is provided with a field force generation element 123, which transfers a generated field to the attraction component 120. Specifically, the field force generation element 123 is an electromagnet, and one end of the electromagnet comes into contact with the attraction component 120; the picking and placing component 12 is provided with a switch 124 controlling on/off of the electromagnet; when the switch 124 is pressed, the electromagnet works to generate a magnetic field that magnetizes the attraction component 120, so that the attraction component 120 attracts the movement component 13.

Figure 30:
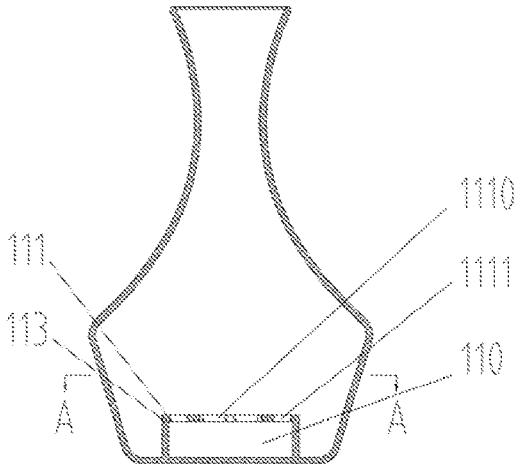
FIG. 30 is a schematic structural diagram of a wine container according to another embodiment.
Figure 31:
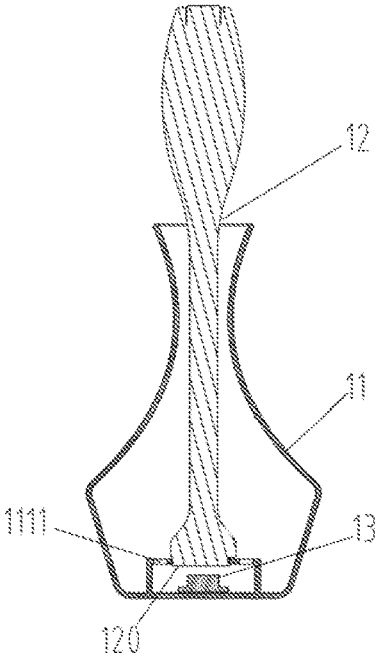
FIG. 31 is a schematic structural diagram of a decanting assembly according to another embodiment.

FIG. 30 and FIG. 31 indicate another embodiment of the present invention. This embodiment differs from the foregoing embodiment in that: referring to FIG. 30, the movement space 110 is disposed in a cover body 113, the top cover 111 is the top of the cover body 113, and the cover body 113 is disposed at the bottom of the wine container 11; referring to FIG. 31, the picking and placing component 12 extends into the wine container 11 from a bottle top of the wine container 11; the attraction component 120 matches against the picking and placing port 1110; under the effect of a field force, the movement component 13 is attracted onto the attraction component 120, and the movement component 13 can be taken out of the wine container 11 after the picking and placing component 12 is drawn out, so as to replace or clean the movement component 13.

Figure 32:
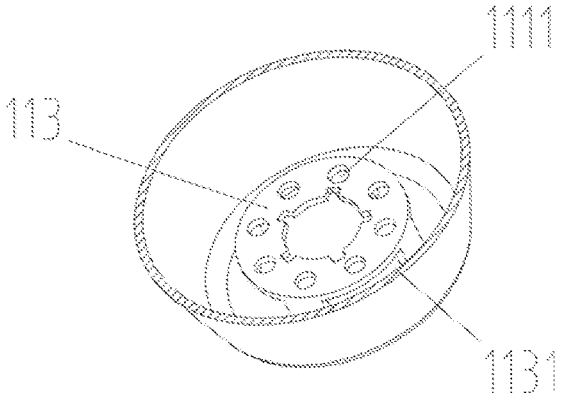
FIG. 32 is a sectional view of a direction A of FIG. 30.

The foregoing embodiment describes the present invention, but the present invention may further have some varied forms, for example:

Referring to FIG. 32, a hollow 1131 is disposed on a side surface of the cover body 113, so that wine in the wine container 11 alternatively enters the movement space 110 for contact with the movement component 13, thereby accelerating decanting.

Figure 33:
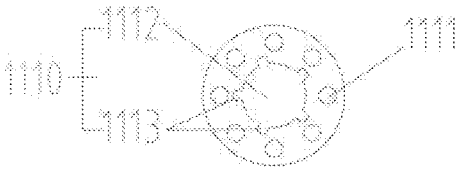
FIG. 33 is a schematic structural diagram of a picking and placing port according to another embodiment.
Figure 34:
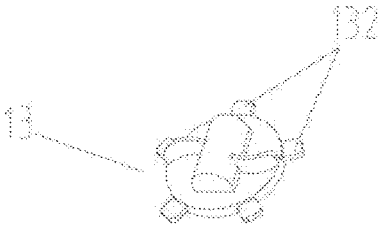
FIG. 34 is a schematic structural diagram of a movement component according to another embodiment.

FIG. 33 and FIG. 34 indicate another embodiment of the present invention. This embodiment differs from the foregoing embodiment in that: referring to FIG. 33, the picking and placing port 1110 includes a central port 1112 and a sub clamping hole 1113; the sub clamping hole 1113 is disposed on the periphery of the central port 1112 and is connected to the central port 1112; referring to FIG. 34, a clamping structure 132 is disposed on the periphery of the movement component 13, and the clamping structure 132 fits the sub clamping hole 1113. Specifically, the picking and placing port 1110 is knurl-shaped, and includes the circular central port 1112 and five rectangular sub clamping holes 1113; the movement component 13 is an impeller, which is circular at the center; a clamping structure 132 is disposed on the periphery of the impeller; the clamping structure 132 is five rectangular feet, which fit the rectangular sub clamping holes 1113. The size of the outer profile of the movement component 13 is slightly less than the size of the inner ring of the picking and placing port 1110. Due to a clamping effect of the sub clamping holes 1113 on the clamping structure 132, referring to FIG. 35, only when the clamping structure 132 is aligned with the sub clamping holes 1113, the movement component 13 can be taken out of the movement space 110, so that the movement component 13 does not easily fall out of the picking and placing port 1110.

The foregoing embodiment describes the present invention, but the present invention may further have some varied forms, for example:

The clamping structure 132 may also be a tooth-shaped or semicircular structure.

Figure 36:
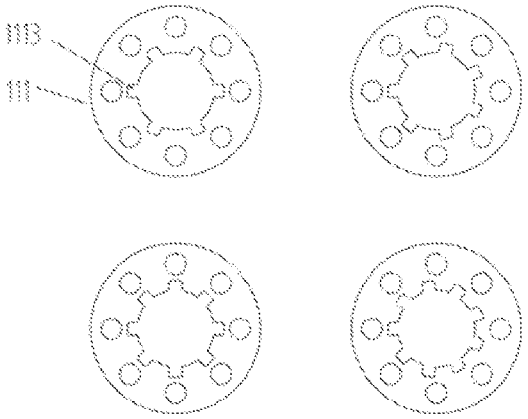
FIG. 36 is a schematic structural diagram of a variation manner of a sub clamping hole.
Figure 37:
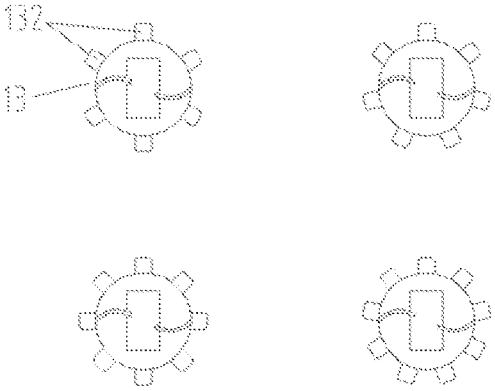
FIG. 37 is a schematic structural diagram of a variation manner of a clamping structure.

Referring to FIG. 36 and FIG. 37, the number of the rectangular feet and the number of the rectangular sub clamping holes may also be one, two, three, four, six, or more.

Figure 38:
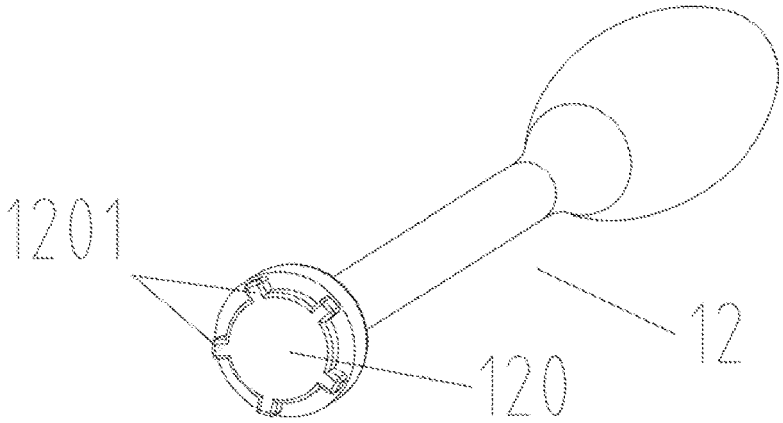
FIG. 38 is a schematic structural diagram of a picking and placing component according to another embodiment.
Figure 39:
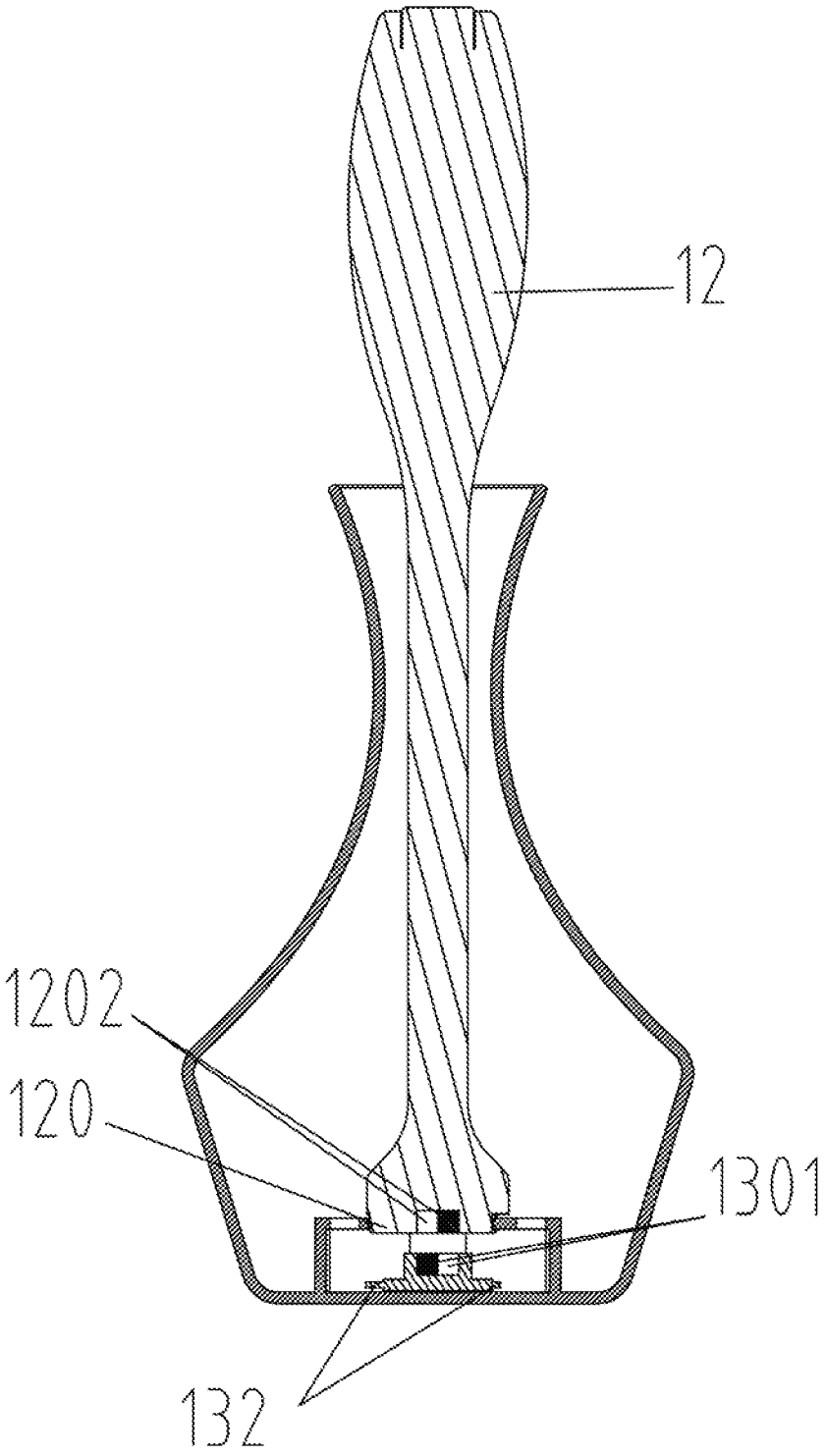
FIG. 39 is a schematic structural diagram of a decanting assembly according to another embodiment.
Figure 40:
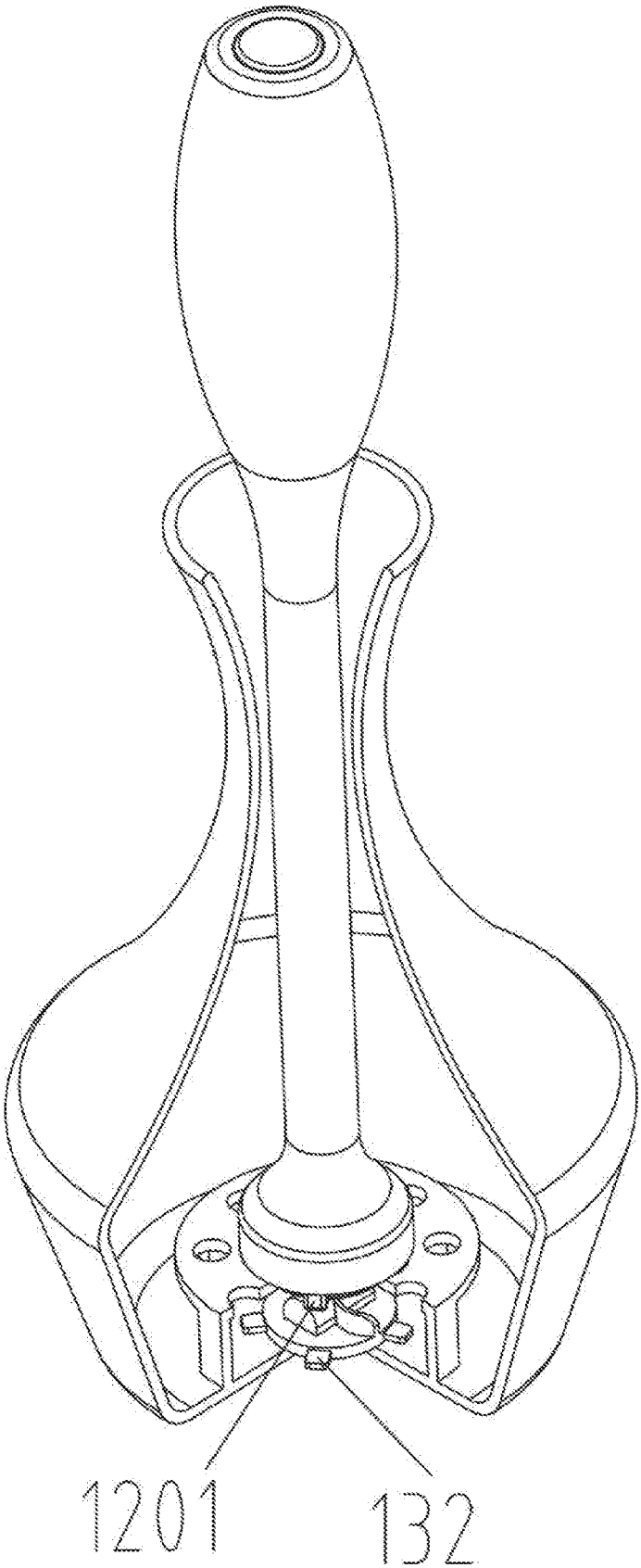
FIG. 40 is a quarter of a sectional view of a decanting assembly according to another embodiment.

FIG. 39 and FIG. 40 indicate another embodiment of the present invention. This embodiment differs from the embodiment shown in FIG. 33 and FIG. 34 in that: referring to FIG. 38, the attraction component 120 of the picking and placing component 12 is a parent positioning structure 1201, and the sub clamping holes 1113 match against the parent positioning structure 1201; referring to FIG. 39, a first magnetic component 1301 is disposed in the movement component 13, a second magnetic component 1202 is disposed in the attraction component 120 of the picking and placing component 12, and the second magnetic component 1202 is a permanent magnet or an electromagnet; the N and S poles of the first magnetic component 1301 are horizontally distributed relative to a cross section of the movement component 13, and the N and S poles of the second magnetic component 1202 are horizontally distributed relative to a cross section of the attraction component 120; directions pointed by the N and S poles of the first magnetic component 1301 and the second magnetic component 1202 satisfy: the first magnetic component 1301 and the second magnetic component 1202 attract each other, so that the clamping structure 132 is aligned with both the sub clamping holes 1113 and the parent positioning structure 1201. The parent positioning structure 1201 is protrusions disposed on the attraction component 120, and these protrusions just fit into the sub clamping holes 1113.

Figure 35:
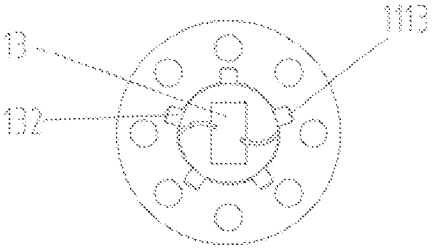
FIG. 35 shows a structure of matching between a movement component and a picking and placing port of the present invention.

According to the foregoing description, it can be learned that the N and S poles of the first magnetic component 1301 are horizontally distributed relative to the cross section of the movement component 13, and the N and S poles of the second magnetic component 1202 are horizontally distributed with respect to the cross section of the attraction component 120; after the parent positioning structure 1201 of the picking and placing component 12 matches against the sub clamping holes 1113, under the effect of a magnetic force, referring to FIG. 40, the movement component 13 is attracted onto the attraction structure 120, so that the clamping structure 132 of the movement component 13 is aligned with the parent positioning structure 1201; referring to FIG. 35, that is, in this way, the clamping structure 132 of the movement component 13 is aligned with the sub clamping holes 1113, to make it convenient to take the movement component 13 out of the wine container 11.

Figure 52:
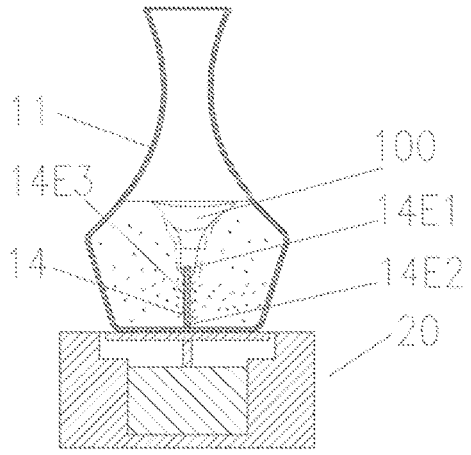
FIG. 52 shows a structure of a fifth variation manner of a decanting device of the present invention.

Based on the foregoing embodiment of the present invention, the present invention may also be implemented in the following manner:

Referring to FIG. 52, the decanting device further includes a guiding component 14, which is configured to guide a gas in the wine container 11. The guiding component 14 and the wine container 11 may be integrally formed or separately formed. When the guiding component 14 and the wine container 11 are separately formed, the guiding component 14 may be connected to the wine container 11, or connected to the decanter 20. One end 14E1 of the guiding component 14 is used for contact with moving grape wine, and the other end 14E2 of the guiding component 14 is used for fixation or mounting of the guiding component 14 itself; at least one part 14E3 of the guiding component 14 can be immersed in the grape wine; one part 14E3 of the guiding component 14 is a part connected to one end 14E1 of the guiding component 14. For example, a middle part of the guiding component 14 may be immersed in the wine, or a part above the middle of the guiding component 14 is immersed in the wine, or a part below one end 14E1 of the guiding component 14 is immersed in the wine. Specific forms of the guiding component 14 may be a bar, a shaft, a rod, a tube, and a sheet, and the materials thereof may be glass, plastics, and metals. In the present invention, the gas is guided by using contact between the guiding component 14 and moving grape wine, so that more gases come into contact with more wine, thereby reducing power consumption. The guiding component 14 may be disposed at various locations in the wine container 11, such as an inner bottom surface and an inner side surface, provided that the guiding component 14 can come into contact with the moving grape wine.

Referring to FIG. 52, the decanter 20 makes, in the following manner, the grape wine in the wine container 11 move: the decanter 20 is a rotation power source; the wine container 11 is connected to the decanter 20, for example, is placed on an upper surface of the decanter 20; the decanter 20 drives the wine container 11 to rotate, so that the grape wine in the wine container 11 rotates; the decanter 20 can make, by means of acceleration or deceleration, the grape wine in the wine container 11 rotate more fiercely. One end 14E1 of the guiding component 14 comes into contact with the moving grape wine, and the other end 14E2 is fixed on an inner bottom surface of the wine container 11. In addition, the decanter 20 may also be a shaking power source, and drives the wine container 11 to shake, thereby making the grape wine in the wine container 11 shake.

Referring to FIG. 52, the grape wine is added to the wine container 11, and the decanter 20 is started to make the grape wine in the wine container 11 move; gases having a decanting function come into contact with the grape wine; these gases enter the wine; because the guiding component 14 comes into contact with the moving grape wine, gases also enter a junction for contact between the guiding component 14 and the moving wine; a part, immersed into the grape wine along the guiding component 14, of the gases enters the grape wine, and these gases come into contact with more grape wine in the wine container 11, thereby accelerating the decanting process. That is, under the effect of the guiding component 14, more gases come into contact with more grape wine, thereby reducing power consumption of the decanting device.

Figure 53:
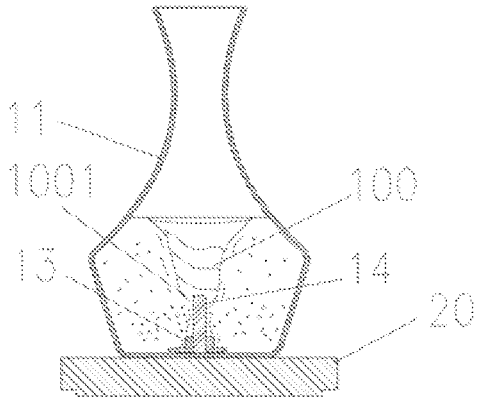
FIG. 53 shows a structure of a sixth variation manner of a decanting device of the present invention.

Referring to FIG. 53, the movement component 13 and the guiding component 14 are cooperatively used. The movement component 13 is placed in the wine container 11; the movement component 13 may be a part belonging to the decanter 20, or may be a component independent of the decanter 20. By making the movement component 13 move in the wine, the decanter 20 makes the wine move, thereby making the wine come into contact with a gas having a decanting function. As stated above, specific forms of movement of the movement component 13 in the grape wine include rotation, vibration, and translation. The specific structure of the movement component 13 may be a rotor, an elastic piece, or a translation mechanism, and may be designed according to actual situations, and the present invention is not limited thereto. The specific manner in which the decanter 20 makes the movement component 13 move in the wine may be: the movement component 13 is made, by using a non-contact force by using a magnetic field, to move, or the decanter 20 is connected to the movement component 13 to drive the movement component 13 to move in the wine.

The present invention is further described below:

Referring to FIG. 53, an acting force of the decanter 20 on the movement component 13 can make the movement component 13 move in the grape wine, so that the gas channel 100 for gas inlet is formed in the grape wine, and the guiding component 14 can come into contact with the gas channel 100. Because the gas channel 100 is formed in the grape wine, the contact between the guiding component 14 and the gas channel 100 naturally leads to the contact between the guiding component 14 and the moving grape wine. The decanter 20 makes the movement component 13 move quickly enough, so that the gas channel 100 is formed in the grape wine. For example, the output power of the decanter 20 is increased.

The existence of the gas channel 100 facilitates contact between more gases and the grape wine in the wine container 11 through the gas channel 100. Due to the contact between the guiding component 14 and the gas channel 100, gases enter the junction for contact between the guiding component 14 and the moving grape wine; under guidance of the guiding component 14, the gases move to other locations in the wine container 11, such as locations where the gas channel 100 is not formed, and the gases come into contact with grape wine at these locations, thereby further accelerating decanting.

Referring to FIG. 53, the guiding component 14 comes into contact with a bottom part 1001 of the gas channel 100. Because the gas channel 100 has a trend of moving downwards after being formed, and the trend drives the grape wine and gases around the gas channel 100 to move downwards, the contact between the guiding component 14 and the bottom part of the gas channel 100 just uses this trend, to make gases move from the bottom part of the gas channel 100 along the guiding component 14, to reduce resistance received by the gases in the grape wine, thereby making the gases come into contact with more grape wine, and achieving a better decanting effect.

Figure 54:
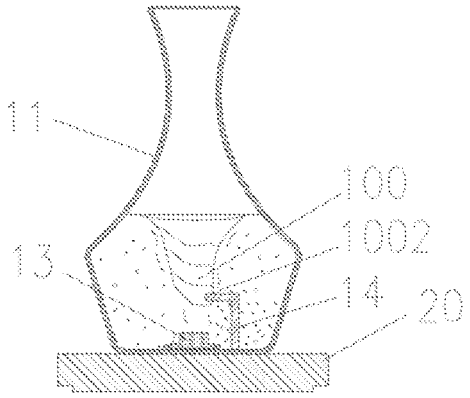
FIG. 54 shows a structure of a seventh variation manner of a decanting device of the present invention.

The foregoing describes the present invention, but the present invention may further have some variation manners, for example:

Referring to FIG. 54, the guiding component 14 may further come into contact with a side part 1002 of the gas channel 100.

Figure 55:
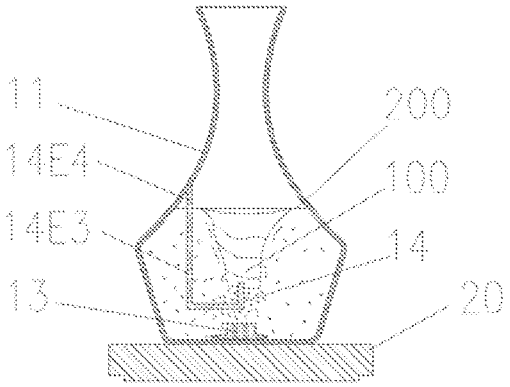
FIG. 55 shows a structure of an eighth variation manner of a decanting device of the present invention.

Referring to FIG. 55, one part 14E3 of the guiding component 14 is immersed in the grape wine, and one part 14E4 may further be located above a liquid level 200 of the grape wine.

The present invention is further described below:

The form of movement of the movement component 13 in the grape wine is rotation, so that the gas channel 100 is more easily formed in the grape wine. That is, the movement component 13 is a rotatable component, and the decanter 20 can make the movement component 13 rotate in the wine. The guiding component 14 may also be connected to the movement component 13.

Figure 56:
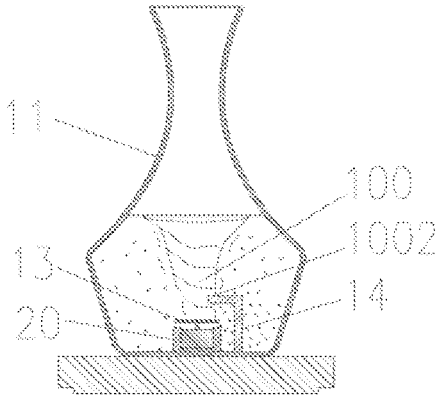
FIG. 56 shows a structure of a ninth variation manner of a decanting device of the present invention.

Referring to FIG. 56, the decanter 20 is connected to the movement component 13, to drive the movement component 13 to rotate in the wine. The decanter 20 is a rotation power source; specifically, the decanter 20 is a waterproof motor or a mechanical energy storage apparatus; the movement component 13 is connected to the decanter 20; the decanter 20 and the movement component 13 are both placed in the wine container 11; at work, the decanter 20 drives the movement component 13 to rotate, so that the grape wine in the wine container 11 rotates to form the gas channel 100.

Figure 57:
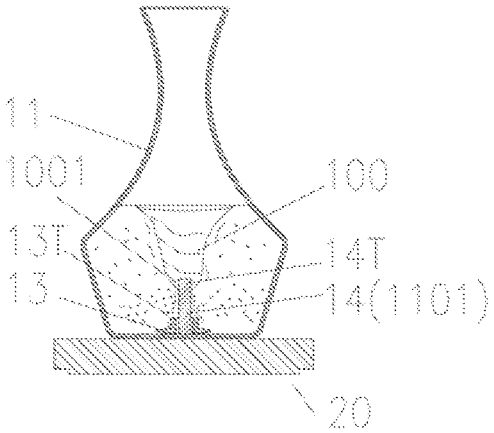
FIG. 57 shows a structure of a tenth variation manner of a decanting device of the present invention.

The present invention is further described below:

The movement component 13 may be disposed on the guiding component 14; for example, referring to FIG. 57, the movement component 13 is sleeved on the guiding component 14, and the movement component 13 is rotatable; or referring to FIG. 53, the movement component 13 is fixedly connected to the guiding component 14, and when rotating, the movement component 13 drives the guiding component 14 to rotate. In addition, referring to FIG. 57, a top part 14T of the guiding component 14 protrudes from a top part 13T of the movement component 13, so that when the movement component 13 rotates, that the guiding component 14 protruding from the movement component 13 can come into contact with the moving grape wine, for example, with the gas channel 100 can be ensured.

Figure 58:
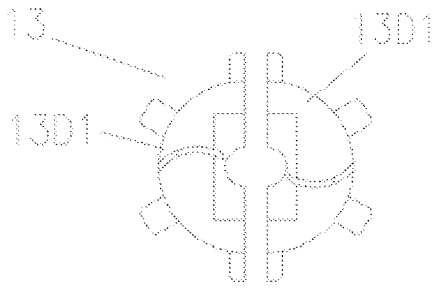
FIG. 58 shows a structure of a variation manner of a movement component of the present invention.

Referring to FIG. 58, the movement component 13 is a split structure, and specifically may be equally divided split structures 13D1; the number of the split structures 13D1 may be two, three, four, five, or more, and these split structures 13D1 are connected to each other to form the movement component 13. The split structures 13D1 may be connected to each other by using a magnetic field force, or are connected by using an adhesive. Because the movement component 13 is a split structure, the movement component 13 can enclose the guiding component from outside of the guiding component 14. Specifically, the split structures 13D1 have magnetism, and are placed on the bottom part of the wine container 11; under the effect of the magnetic field force, the split structures 13D1 are attracted together to enclose the guiding component 14. The movement component 13 can rotate by using the guiding component 14 as an axis, and the implementation thereof may be that the movement component 13 is in clearance fit with the guiding component 14 or the movement component 13 drives the guiding component 14 to rotate. Referring to FIG. 6, the top part 14T of the guiding component 14 protrudes from the top part 13T of the movement component 13, to come into contact with the moving wine.

Referring to FIG. 30 and FIG. 58, the structure of the picking and placing port 1110 is set to allow a single split structure 13D1 to pass, but clamp a combination formed by connecting at least two split structures 13D1; for example, the size of the outer profile of the split structure 13D1 is slightly less than the size of the inner ring of the picking and placing port 1110, so that the split structure 13D1 can be picked from and placed into the picking and placing port 1110. In this way, the single split structure 13D1 can be placed into the movement space 110 through the picking and placing port 1110; a plurality of split structures 13D1 are connected to each other in the movement space 110 to form the movement component 13, so as to perform decanting. When the movement component 13 needs to be taken out of the movement space 110, the movement component 13 is divided in the movement space 110 by using a tool such as a picking and placing component 12, so that the movement component 13 is divided into a plurality of split structures 13D1, and then the split structures 13D1 are taken out of the picking and placing port 1110. In this way, the movement component 13 can be effectively prevented from falling out of the wine container 11 during wine pouring.

Referring to FIG. 57 and FIG. 58, the guiding component 14 may be a fixing shaft 1101 disposed in the wine container 11; the movement component 13 is sleeved on the guiding component 14; such a movement component 13 has a simple structure and is easy to process, and is conveniently integrally formed with the wine container.

Figure 59:
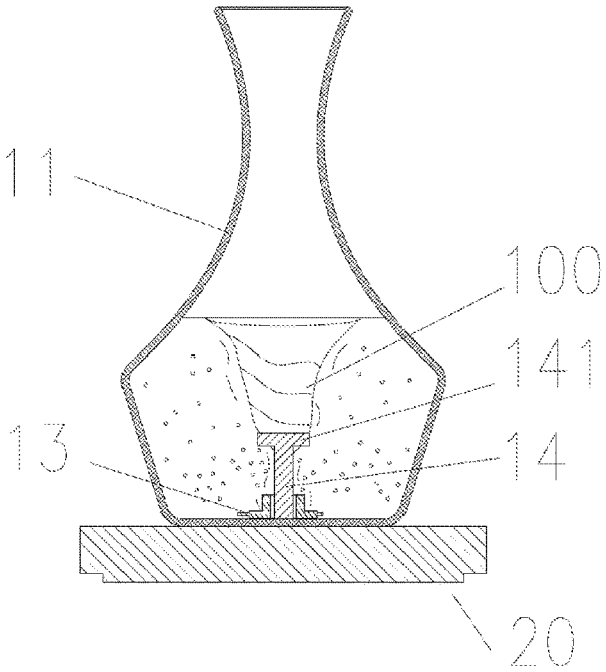
FIG. 59 shows a structure of a variation manner of a guiding component of the present invention.

The present invention is further described below:

Referring to FIG. 59, the guiding component 14 is provided with a first structure 141, which is configured to prevent the movement component 13 from breaking away from the guiding component 14 from one end of the guiding component 14, for example, prevent the movement component from being poured out with the grape wine when decanting and wine pouring are completed. The movement component 13 is a split structure, and encloses the guiding component 14 from outside of the guiding component; when the movement component 13 is prevented from breaking away from the guiding component 14, the assembly of the movement component 13 and the guiding component 14 is simplified, and the processing requirements of the guiding component 14 and the movement component 13 are reduced, thereby reducing costs.

Figure 60:
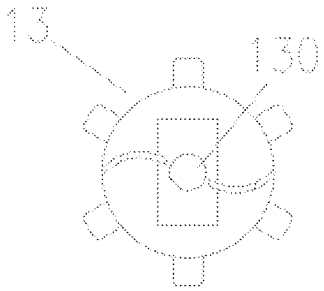
FIG. 60 shows a structure of another variation manner of a movement component of the present invention.

Specifically, referring to FIG. 59 and FIG. 60, the movement component 13 can form a first through hole 130 in clearance fit with the outside of the guiding component 14; the size of the outer profile of the first structure 141 is greater than the size of the first through hole 130; the movement component 13 is a split structure, and encloses the guiding component 14 from outside of the guiding component; when the movement component 13 is prevented from breaking away from the guiding component 14 from one end of the guiding component 14, the assembly of the movement component 13 and the guiding component 14 is also implemented.

Figure 61:
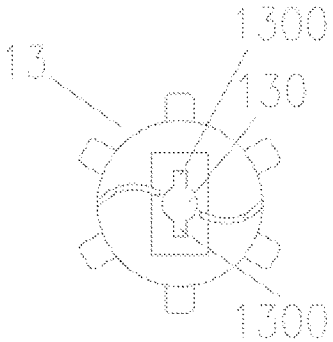
FIG. 61 shows a structure of a third variation manner of a movement component of the present invention.

In addition, referring to FIG. 59 and FIG. 61, the first through hole 130 is provided with a first sub through hole 1300; the first structure 141 may be placed in the first sub through hole 1300; and the first structure 141 is in clearance fit with the first sub through hole 1300. The advantage is that when the first sub through hole 1300 is aligned with the first structure 141, the movement component 13 can be taken out of the guiding component 14, or the movement component 13 is placed on the guiding component 14.

The specific form of the first structure 141 may be a part of the guiding component 14, such as a protrusion on the guiding component 14 or a component connected to the guiding component 14 such as a nut or a clamping mechanism.

Figure 62:
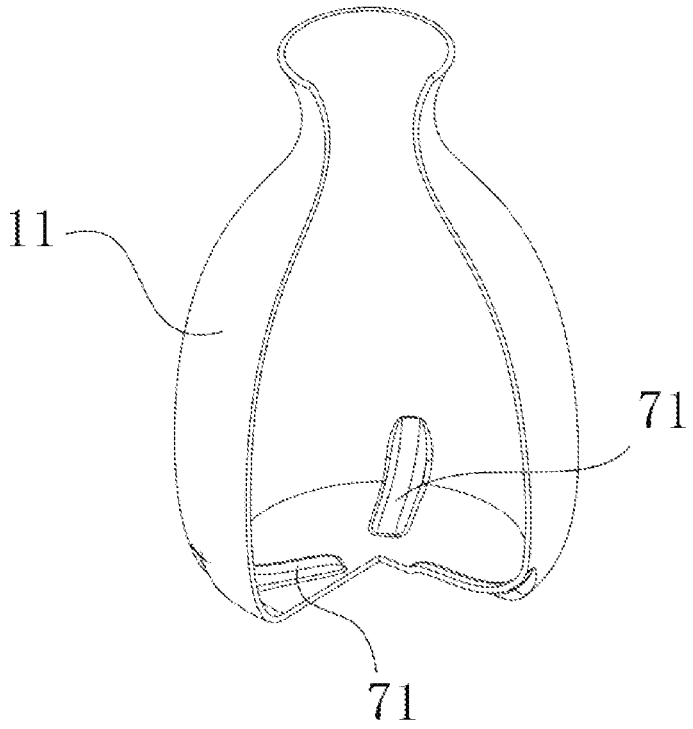
FIG. 62 is a schematic structural diagram of a variation manner of a wine container of the present invention.

Referring to FIG. 62, a protrusion 71 may also be disposed on an inner bottom surface of the wine container 11, and may be wave edges distributed in a circular array, such as three wave edges, which are not in contact with each other. The setting of the protrusion 71 makes the grape wine receive resistance of the protrusion 71 in a rotation process, to generate convections, thereby facilitating acceleration of the decanting speed.

The inner bottom surface of the wine container 11 may also be a curved surface protruding downwards, that is, the middle of the inner bottom surface is low and the periphery is high; in this way, when the grape wine rotates, the grape wine not only flows on a rotation surface, but also flows from the edge to the center, thereby increasing internal flow of the grape wine.

The present invention is further described above in detail with reference to specific/preferred implementations. It should be noted that the technical features in the embodiments of the present invention can be combined with each other. In spite of this, it cannot be determined that the specific implementation of the present invention is limited thereto. For a person of ordinary skill in the art to which the present invention belongs, on a precondition of not departing from a conception of the present invention, he/she may further make several replacements or modifications on the described implementations, and these replacement or modification manners should be considered to fall within the protection scope of the present invention.

What is claimed is:

1. A wine decanter, comprising a housing and a variation magnetic field generator, wherein the variation magnetic field generator is configured to generate a variation magnetic field, and the variation magnetic field generator generates the variation magnetic field, so that a movement component that can sense a magnetic field moves in wine to make the wine move, thereby increasing contact between the wine and air; further comprising a magnetic field adjustment unit, wherein the magnetic field adjustment unit is connected to the housing or disposed in the variation magnetic field generator, and is configured to adjust distribution of magnetic fields generated by the variation magnetic field generator; and by means of adjustment of the distribution of magnetic fields, the movement component that can sense a magnetic field moves to different locations in the wine for movement, to enhance a decanting effect; wherein types of the magnetic field adjustment unit comprise a magnetic field space distribution adjustment unit and a magnetic field strength distribution adjustment unit, the magnetic field space distribution adjustment unit is connected to the housing, the magnetic field strength distribution adjustment unit is disposed in the variation magnetic field generator, the magnetic field space distribution adjustment unit is configured to change a spatial location of a magnetic field, and the magnetic field strength distribution adjustment unit is configured to adjust strength distribution of magnetic fields.

2. The wine decanter according to claim 1, wherein the magnetic field generated by the variation magnetic field generator drives the movement component to move in the wine, so that a gas channel for gas inlet is formed in the wine, and the movement component beats air entering the gas channel into the wine.

3. The wine decanter according to claim 1, wherein the magnetic field generated by the variation magnetic field generator drives the movement component to rotate in the wine, so that a gas channel for gas inlet is formed in the wine, and the movement component beats air entering the gas channel into the wine.

4. The wine decanter according to claim 1, wherein the variation magnetic field generator comprises a coil winding and a power supply circuit, and the coil winding is connected to the power supply circuit.

5. The wine decanter according to claim 1, wherein the magnetic field strength distribution adjustment unit comprises a control unit, a power supply circuit, and an adjustment coil winding, the control unit is configured to send a control signal to the power supply circuit, the adjustment coil winding is connected to the power supply circuit, and the control signal of the control unit can control strength of a magnetic field generated by the adjustment coil winding.

6. The wine decanter according to claim 1, wherein the magnetic field space distribution adjustment unit comprises a translation mechanism and a supporting structure, the translation mechanism is configured to move the housing, and the supporting structure is configured to support a wine container, so that the housing can move relative to the wine container.

7. The wine decanter according to claim 1, wherein the variation magnetic field generator is a stator.

8. The wine decanter according to claim 4, wherein shapes of the decanter comprise a disk shape, an annular shape, and a flat shape.

9. The wine decanter according to claim 1, wherein a variation of the magnetic field generated by the variation magnetic field generator comprises a magnetic field direction variation, a magnetic field strength variation, a magnetic field distribution variation, or a magnetic field direction and distribution variation.

10. The wine decanter according to claim 4, wherein there is one, two, three, four, or more coil windings.

11. The wine decanter according to claim 4, further comprising a control unit, wherein the control unit is connected to the power supply circuit, and the control unit is configured to change an output signal of the power supply circuit.

12. The wine decanter according to claim 1, wherein types of movement of the movement component in the wine comprise rotation, vibration, and translation.

13. A wine decanting device, comprising the wine container, the movement component, and the decanter according to claim 1, wherein the movement component is placed inside the wine container, the decanter is connected to the movement component by using a magnetic field, and the decanter generates a variation magnetic field to drive the movement component to perform decanting.

14. The wine decanting device according to claim 13, wherein the decanter and the movement component are disposed in a separate manner.

15. The wine decanting device according to claim 14, wherein the movement component is partially a magnetic material or is entirely a magnetic material.

16. The wine decanting device according to claim 15, wherein the movement component is partially a magnetic material, and the magnetic material is disposed on two ends of the movement component or is disposed in the middle of the movement component.

17. The wine decanting device according to claim 13, wherein a rotation space is disposed inside the wine container, a top cover is disposed on top of the rotation space, a picking and placing port is disposed on the top over, and the rotation space is used for accommodating a decanting rotor; and the decanting device further comprises a picking and placing component, one end of the picking and placing component is provided with an attraction component, and the attraction component is connected to the picking and placing port of the wine container in a matching manner for cooperative use, and the attraction component is a magnetic field sensing component.

18. The wine decanting device according to claim 13, further comprising a guiding component, wherein the guiding component is configured to guide a gas in the wine container, and the guiding component comes into contact with moving wine, to guide the gas, so that more gases come into contact with more wine.

* * * * *